US010373453B2

(12) United States Patent
Hicks, III

(10) Patent No.: US 10,373,453 B2
(45) Date of Patent: Aug. 6, 2019

(54) METHODS, SYSTEMS, AND PRODUCTS FOR SECURITY SERVICES

(71) Applicant: AT&T Intellectual Property I, L.P., Atlanta, GA (US)

(72) Inventor: John Alson Hicks, III, Roswell, GA (US)

(73) Assignee: AT&T INTELLECTUAL PROPERTY I, L.P., Atlanta, GA (US)

( * ) Notice: Subject to any disclaimer, the term of this patent is extended or adjusted under 35 U.S.C. 154(b) by 0 days.

(21) Appl. No.: 14/854,294

(22) Filed: Sep. 15, 2015

(65) Prior Publication Data

US 2017/0076562 A1 Mar. 16, 2017

(51) Int. Cl.

| | |
|---|---|
| ***G08B 1/08*** | (2006.01) |
| ***G08B 7/06*** | (2006.01) |
| ***G08B 25/01*** | (2006.01) |
| ***G08B 25/14*** | (2006.01) |
| *G08B 25/00* | (2006.01) |

(52) U.S. Cl.

CPC ..... *G08B 7/06* (2013.01); *G08B 25/012* (2013.01); *G08B 25/14* (2013.01); *G08B 7/066* (2013.01); *G08B 25/009* (2013.01); *G08B 25/016* (2013.01)

(58) Field of Classification Search

CPC ..... G08B 5/224; G08B 25/10; G08B 25/016; G08B 17/10; G08B 21/182; G08B 13/196; G08B 13/19671; G06F 21/6218

See application file for complete search history.

(56) References Cited

U.S. PATENT DOCUMENTS

| | | | |
|---|---|---|---|
| 4,259,548 | A | 3/1981 | Fahey et al. |
| 6,038,289 | A | 3/2000 | Sands |
| 6,067,346 | A | 5/2000 | Akhteruzzaman et al. |
| 6,271,752 | B1 | 8/2001 | Vaios |
| 6,356,058 | B1 | 3/2002 | Maio |
| 6,400,265 | B1 | 6/2002 | Saylor et al. |
| 6,504,479 | B1 | 1/2003 | Lemons |
| 6,636,489 | B1 | 10/2003 | Fingerhut |
| 6,658,091 | B1 | 12/2003 | Naidoo et al. |
| 6,693,530 | B1 | 2/2004 | Dowens et al. |
| 6,741,171 | B2 | 5/2004 | Palka et al. |
| 6,778,085 | B2 | 8/2004 | Faulkner |
| 6,829,478 | B1 | 12/2004 | Layton et al. |

(Continued)

FOREIGN PATENT DOCUMENTS

| | | | |
|---|---|---|---|
| JP | 2014216663 | A | 11/2014 |
| KR | 20070105430 | A | 10/2007 |

OTHER PUBLICATIONS

Unpublished—U.S. Appl. No. 14/833,098, Hicks, III, John Alson.

(Continued)

*Primary Examiner* — An T Nguyen

(74) *Attorney, Agent, or Firm* — Scott P. Zimmerman, PLLC

(57) ABSTRACT

Personalized notifications of security events are sent. When an alarm condition is determined, a remote notification address may be retrieved. Personalized text may also be retrieved that describes the alarm condition. A notification message may thus be sent to the remote notification address, with the personalized text describing the alarm condition in a user's own words. The personalized text may then be converted to speech, thus providing an audible announcement of the alarm condition.

17 Claims, 31 Drawing Sheets

(56) References Cited

U.S. PATENT DOCUMENTS 6,884,826 B2 4/2005 Le-Khac et al.
6,914,896 B1 7/2005 Tomalewicz
6,970,183 B1 11/2005 Monroe
6,975,220 B1 12/2005 Foodman et al.
6,977,585 B2 12/2005 Falk et al.
7,015,806 B2 3/2006 Naidoo et al.
7,020,796 B1 3/2006 Ennis et al.
7,035,650 B1 4/2006 Moskowitz et al.
7,113,090 B1 9/2006 Saylor et al.
7,239,689 B2 7/2007 Diomelli
7,248,161 B2 7/2007 Spoltore et al.
7,249,370 B2 7/2007 Kodama
7,295,119 B2 11/2007 Rappaport et al.
7,323,980 B2 1/2008 Faulkner et al.
7,492,253 B2 2/2009 Ollis et al.
7,515,041 B2 4/2009 Eisold et al.
7,633,385 B2 12/2009 Cohn et al.
7,679,507 B2 3/2010 Babich et al.
7,688,203 B2 3/2010 Rockefeller et al.
7,724,131 B2 5/2010 Chen
7,768,414 B2 8/2010 Abel et al.
7,772,971 B1 8/2010 Hillenburg et al.
7,779,141 B2 8/2010 Hashimoto et al.
7,853,261 B1 12/2010 Lewis et al.
7,855,635 B2 12/2010 Cohn et al.
7,920,580 B2 4/2011 Bedingfield, Sr.
7,920,843 B2 4/2011 Martin et al.
7,952,609 B2 5/2011 Simerly et al.
8,265,938 B1 * 9/2012 Verna ..... H04W 4/90 704/274
8,284,254 B2 10/2012 Romanowich et al.
8,373,538 B1 2/2013 Hildner et al.
8,391,826 B2 3/2013 McKenna
8,401,514 B2 3/2013 Ebdon et al.
8,405,499 B2 3/2013 Hicks, III
8,471,910 B2 6/2013 Cleary et al.
8,520,068 B2 8/2013 Naidoo et al.
8,581,991 B1 11/2013 Clemente
8,626,210 B2 1/2014 Hicks, III
8,649,758 B2 2/2014 Sennett et al.
8,674,823 B1 3/2014 Contario et al.
8,692,665 B2 4/2014 Hicks, III
8,780,199 B2 7/2014 Mimar
8,831,970 B2 9/2014 Weik et al.
8,847,749 B2 9/2014 Hicks, III
8,884,772 B1 11/2014 Zhang
8,902,740 B2 12/2014 Hicks, III
8,937,658 B2 1/2015 Hicks, III
8,970,365 B2 3/2015 Wedig et al.
9,060,116 B2 6/2015 Kim
9,135,806 B2 9/2015 Hicks
9,246,740 B2 1/2016 Hicks
9,318,005 B2 4/2016 Hicks
2002/0175995 A1 11/2002 Sleeckx
2002/0193107 A1 12/2002 Nascimento
2003/0025599 A1 2/2003 Monroe
2003/0062997 A1 4/2003 Naidoo
2003/0179712 A1 9/2003 Kobayashi et al.
2003/0227220 A1 12/2003 Biskup et al.
2004/0028391 A1 2/2004 Black et al.
2004/0086088 A1 5/2004 Naidoo et al.
2004/0086091 A1 5/2004 Naidoo et al.
2004/0086093 A1 5/2004 Schranz
2004/0113770 A1 6/2004 Falk
2004/0137959 A1 7/2004 Salzhauer
2004/0177136 A1 9/2004 Chen et al.
2004/0196833 A1 10/2004 Dahan et al.
2004/0233983 A1 11/2004 Crawford et al.
2005/0066033 A1 3/2005 Cheston et al.
2005/0068175 A1 3/2005 Faulkner et al.
2005/0174229 A1 8/2005 Feldkamp
2006/0002721 A1 1/2006 Sasaki
2006/0028488 A1 2/2006 Gabay et al.
2006/0055529 A1 3/2006 Ratiu et al.
2006/0064505 A1 3/2006 Lee et al.
2006/0067484 A1 3/2006 Elliot et al.
2006/0154642 A1 7/2006 Scannell, Jr.
2006/0170778 A1 8/2006 Ely
2006/0239250 A1 10/2006 Elliot et al.
2007/0049259 A1 3/2007 Onishi et al.
2007/0104218 A1 5/2007 Hassan et al.
2007/0115930 A1 5/2007 Reynolds et al.
2007/0124782 A1 5/2007 Hirai et al.
2007/0139192 A1 6/2007 Wimberly et al.
2007/0226344 A1 9/2007 Sparrell et al.
2007/0247187 A1 10/2007 Webber et al.
2007/0279214 A1 12/2007 Buehler
2007/0290830 A1 12/2007 Gurley
2008/0055423 A1 3/2008 Ying
2008/0061923 A1 3/2008 Simon et al.
2008/0090546 A1 4/2008 Dickenson et al.
2008/0167068 A1 7/2008 Mosleh et al.
2008/0191857 A1 8/2008 Mojaver
2008/0225120 A1 9/2008 Stuecker
2008/0261515 A1 10/2008 Cohn et al.
2008/0279345 A1 11/2008 Zellner et al.
2008/0311878 A1 12/2008 Martin et al.
2008/0311879 A1 12/2008 Martin et al.
2009/0006525 A1 1/2009 Moore
2009/0010493 A1 1/2009 Gornick
2009/0017751 A1 1/2009 Blum
2009/0047016 A1 2/2009 Bernard et al.
2009/0058630 A1 3/2009 Friar et al.
2009/0060530 A1 3/2009 Biegert et al.
2009/0109898 A1 4/2009 Adams et al.
2009/0191858 A1 7/2009 Calisti et al.
2009/0267754 A1 10/2009 Nguyen et al.
2009/0274104 A1 11/2009 Addy
2009/0276713 A1 11/2009 Eddy
2009/0285369 A1 11/2009 Kandala
2009/0315699 A1 12/2009 Satish et al.
2009/0323904 A1 12/2009 Shapiro et al.
2010/0073856 A1 3/2010 Huang et al.
2010/0145161 A1 6/2010 Niyato et al.
2010/0279664 A1 11/2010 Chalk
2010/0281312 A1 11/2010 Cohn et al.
2010/0302025 A1 12/2010 Script
2010/0302938 A1 12/2010 So
2011/0003577 A1 1/2011 Rogalski et al.
2011/0032109 A1 * 2/2011 Fox ..... G08B 25/006 340/628
2011/0044210 A1 2/2011 Yokota
2011/0058034 A1 3/2011 Grass
2011/0090334 A1 * 4/2011 Hicks, III ..... G08B 13/19656 348/143
2011/0113142 A1 5/2011 Rangegowda et al.
2011/0183643 A1 7/2011 Martin et al.
2011/0197246 A1 8/2011 Stancato et al.
2011/0211440 A1 9/2011 Arsenault et al.
2011/0244854 A1 10/2011 Hansson et al.
2011/0254681 A1 10/2011 Perkinson
2011/0317622 A1 12/2011 Arsenault
2012/0084857 A1 * 4/2012 Hubner ..... G08B 25/001 726/22
2012/0099253 A1 4/2012 Tang
2012/0099256 A1 4/2012 Fawcett
2012/0163380 A1 6/2012 Kolbe et al.
2012/0190386 A1 7/2012 Anderson
2012/0278453 A1 11/2012 Baum
2012/0314597 A1 12/2012 Singh et al.
2013/0027561 A1 1/2013 Lee
2013/0099919 A1 4/2013 Cai et al.
2013/0103309 A1 4/2013 Cai et al.
2013/0120132 A1 5/2013 Hicks, III
2013/0120138 A1 * 5/2013 Hicks, III ..... G08B 13/19697 340/538
2013/0121239 A1 5/2013 Hicks, III
2013/0135993 A1 5/2013 Morrill et al.
2013/0155245 A1 6/2013 Slamka
2013/0170489 A1 7/2013 Hicks, III
2013/0214925 A1 * 8/2013 Weiss ..... G08B 25/001 340/539.11
2013/0235209 A1 9/2013 Lee et al.
2013/0273875 A1 10/2013 Martin et al.

(56) References Cited

U.S. PATENT DOCUMENTS

| | | | | |
|---|---|---|---|---|
| 2014/0095164 | A1 | 4/2014 | Sone et al. | |
| 2014/0167969 | A1* | 6/2014 | Wedig | G08B 7/066 340/584 |
| 2014/0253326 | A1 | 9/2014 | Cho et al. | |
| 2015/0054645 | A1 | 2/2015 | Hicks, III | |
| 2015/0056946 | A1 | 2/2015 | Leggett et al. | |
| 2015/0085130 | A1 | 3/2015 | Hicks, III | |
| 2015/0097683 | A1 | 4/2015 | Sloo et al. | |
| 2015/0137967 | A1 | 5/2015 | Wedig et al. | |
| 2015/0364029 | A1 | 12/2015 | Hicks, III | |
| 2016/0196734 | A1 | 7/2016 | Hicks, III | |
| 2016/0225239 | A1 | 8/2016 | Hicks, III | |
| 2016/0284205 | A1 | 9/2016 | Hicks, III | |
| 2017/0076562 | A1 | 3/2017 | Hicks, III | |
| 2017/0132890 | A1 | 5/2017 | Hicks, III | |
| 2017/0140620 | A1 | 5/2017 | Hicks, III | |

OTHER PUBLICATIONS

Unpublished U.S. Appl. No. 14/854,294, Hicks, III, John Alson.
Aedo, Ignacio, et al., "Personalized alert notifications and evacuation routes in indoor environments," *Sensors* 12.6 (2012): 7804-7827.
Unpublished U.S. Appl. No. 14/939,212, Hicks, III, John Alson.

* cited by examiner

FIG. 12

200

202

| Alarm Sensor(s) | Alarm Code(s) | Notification Addresses | Predetermined Text | Audio File | Video File |
|---|---|---|---|---|---|
| Heat, Smoke | Code1 | Address1 | Text1 | File1 | File8 |
| Water | Code5 | Address1, Address2 | Text2 | Files 2 & 3 | File12 |
| Motion, Contact | Code12 | Address3 | Text3 | File4 | File35 |
| Glass Breakage | Code3 | Address1, Address6, Address9 | Text4 | File5 | File19 |

24 194 52 60 70 72

40

METHODS, SYSTEMS, AND PRODUCTS FOR SECURITY SERVICES

BACKGROUND

Exemplary embodiments generally relate to communications and, more particularly, to alarm systems and to sensing conditions.

Security systems are common in homes and businesses. Security systems alert occupants to intrusions. Security systems, though, may also warn of fire, water, and harmful gases.

BRIEF DESCRIPTION OF THE SEVERAL VIEWS OF THE DRAWINGS

These and other features, aspects, and advantages of the exemplary embodiments are better understood when the following Detailed Description is read with reference to the accompanying drawings, wherein:

FIGS. 11-13 illustrate personal notifications, according to exemplary embodiments;

DETAILED DESCRIPTION

The exemplary embodiments will now be described more fully hereinafter with reference to the accompanying drawings. The exemplary embodiments may, however, be embodied in many different forms and should not be construed as limited to the embodiments set forth herein. These embodiments are provided so that this disclosure will be thorough and complete and will fully convey the exemplary embodiments to those of ordinary skill in the art. Moreover, all statements herein reciting embodiments, as well as specific examples thereof, are intended to encompass both structural and functional equivalents thereof. Additionally, it is intended that such equivalents include both currently known equivalents as well as equivalents developed in the future (i.e., any elements developed that perform the same function, regardless of structure).

Thus, for example, it will be appreciated by those of ordinary skill in the art that the diagrams, schematics, illustrations, and the like represent conceptual views or processes illustrating the exemplary embodiments. The functions of the various elements shown in the figures may be provided through the use of dedicated hardware as well as hardware capable of executing associated software. Those of ordinary skill in the art further understand that the exemplary hardware, software, processes, methods, and/or operating systems described herein are for illustrative purposes and, thus, are not intended to be limited to any particular named manufacturer.

As used herein, the singular forms "a," "an," and "the" are intended to include the plural forms as well, unless expressly stated otherwise. It will be further understood that the terms "includes," "comprises," "including," and/or "comprising," when used in this specification, specify the presence of stated features, integers, steps, operations, elements, and/or components, but do not preclude the presence or addition of one or more other features, integers, steps, operations, elements, components, and/or groups thereof. It will be understood that when an element is referred to as being "connected" or "coupled" to another element, it can be directly connected or coupled to the other element or intervening elements may be present. Furthermore, "connected" or "coupled" as used herein may include wirelessly connected or coupled. As used herein, the term "and/or" includes any and all combinations of one or more of the associated listed items.

It will also be understood that, although the terms first, second, etc. may be used herein to describe various elements, these elements should not be limited by these terms. These terms are only used to distinguish one element from another. For example, a first device could be termed a second device, and, similarly, a second device could be termed a first device without departing from the teachings of the disclosure.

Figure 1:
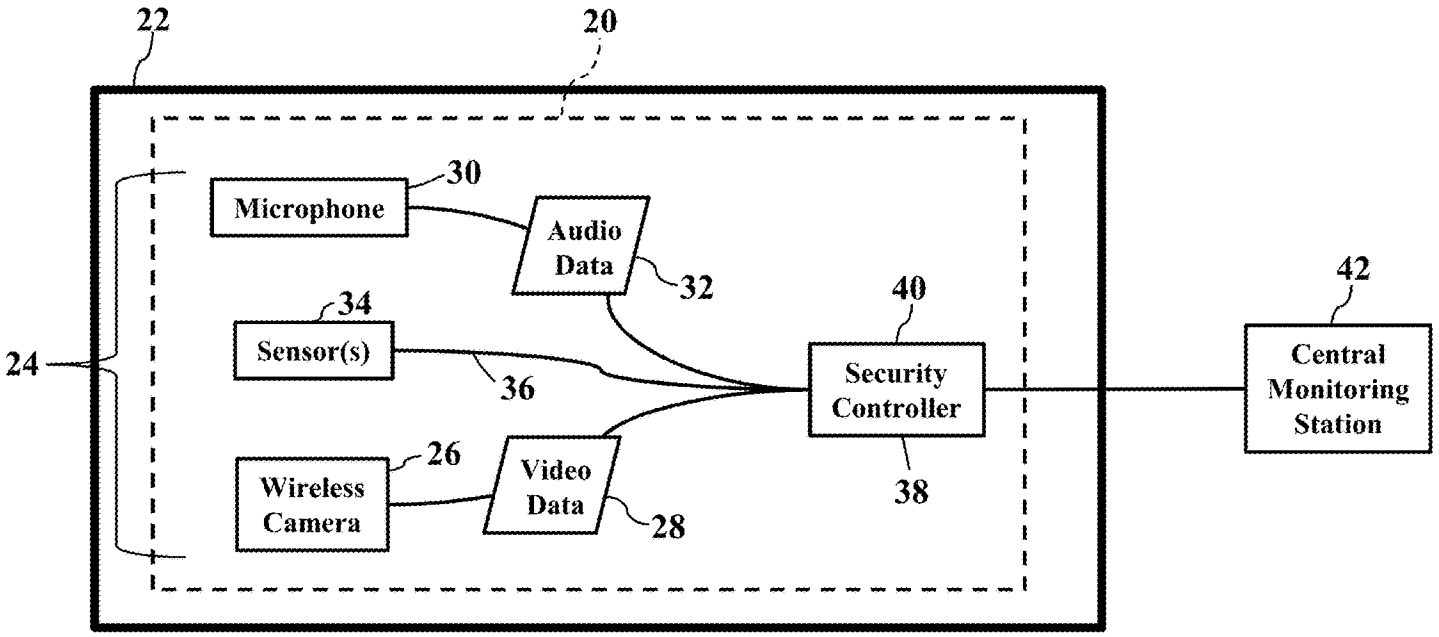
FIGS. 1-8 are simplified illustrations of an operating environment, according to exemplary embodiments.

FIGS. 1-8 are simplified illustrations of an operating environment, according to exemplary embodiments. While exemplary embodiments may be implemented in many environments, FIG. 1 illustrates a common operating environment that most readers will understand. A security system 20 is installed in a building 22, such as a home or business. The security system 20 may have many sensors 24 that protect occupants from fire, intrusion, and other security conditions. For example, a wireless camera 26 captures video data 28 of an entry door or other location in the building 22. A microphone 30 may generate audio data 32. Other sensors 34 (such as motion detectors, carbon monoxide and fire sensors, water sensors, and any other sensory devices) may also monitor areas of the building 22 and generate sensory data 36. If any sensor 24 measures or determines an abnormal or elevated sensory reading, the sensor 24 notifies a security controller 38. The security controller 38 evaluates various logical rules and confirms an alarm condition 40 indicating a fire, intrusion, or other security event. The security controller 38 then notifies a central monitoring station 42, as is known. Emergency personnel may then be summoned.

Figure 2:
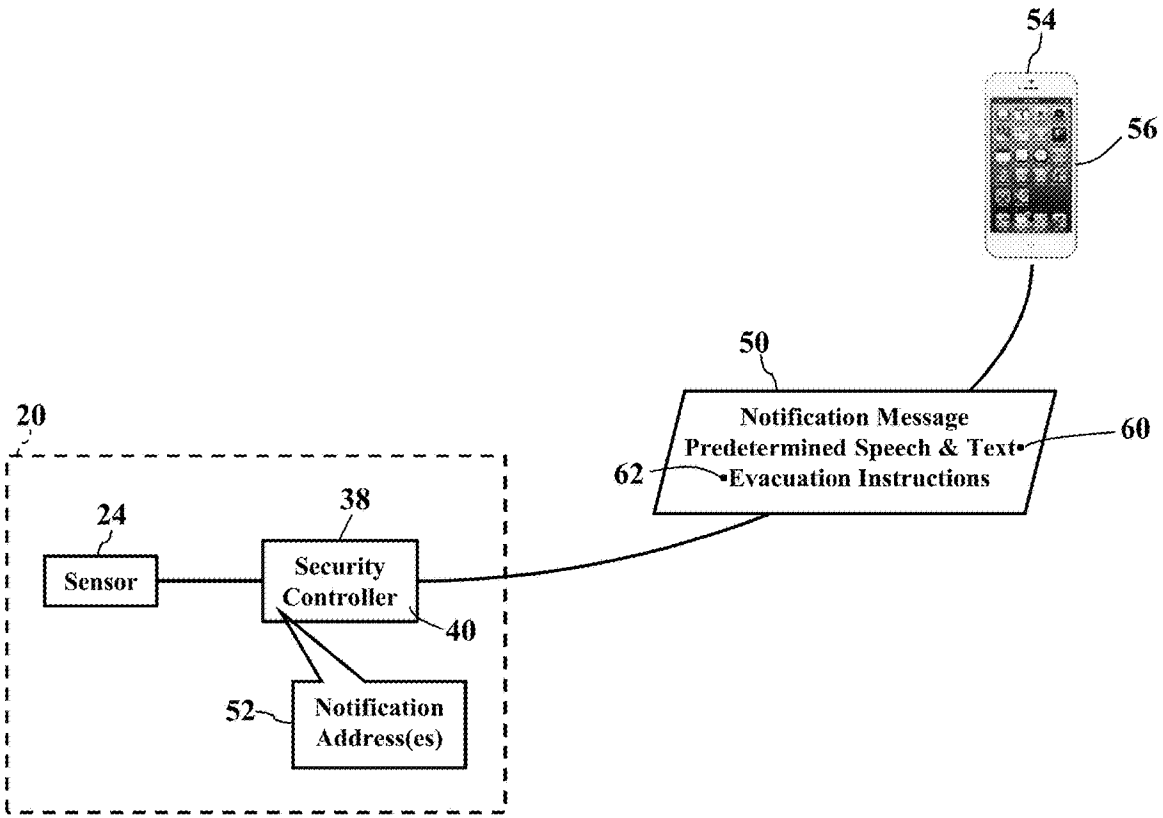

FIG. 2 illustrates personal notifications. When the security controller 38 determines the alarm condition 40, exemplary embodiments may also notify occupants, family members, and friends. The security controller 38, for example, may authorize or generate an electronic notification message 50 that is sent to one or more notification addresses 52 associated with different user devices 54. FIG. 2, for simplicity, illustrates a mobile smartphone 56. When the security controller 38 determines the alarm condition 40, the security controller 38 may notify the mobile smartphone 56. The notification message 50 includes information that describes the alarm condition 40, such as the sensor(s) 24 detecting smoke, heat, and/or intrusion. The notification message 50 may also include predetermined speech and text 60, such as evacuation instructions 62. The predetermined speech and text 60 may thus describe the alarm condition 40 and/or the evacuation instructions in the user's own spoken and/or written words.

Figure 3:
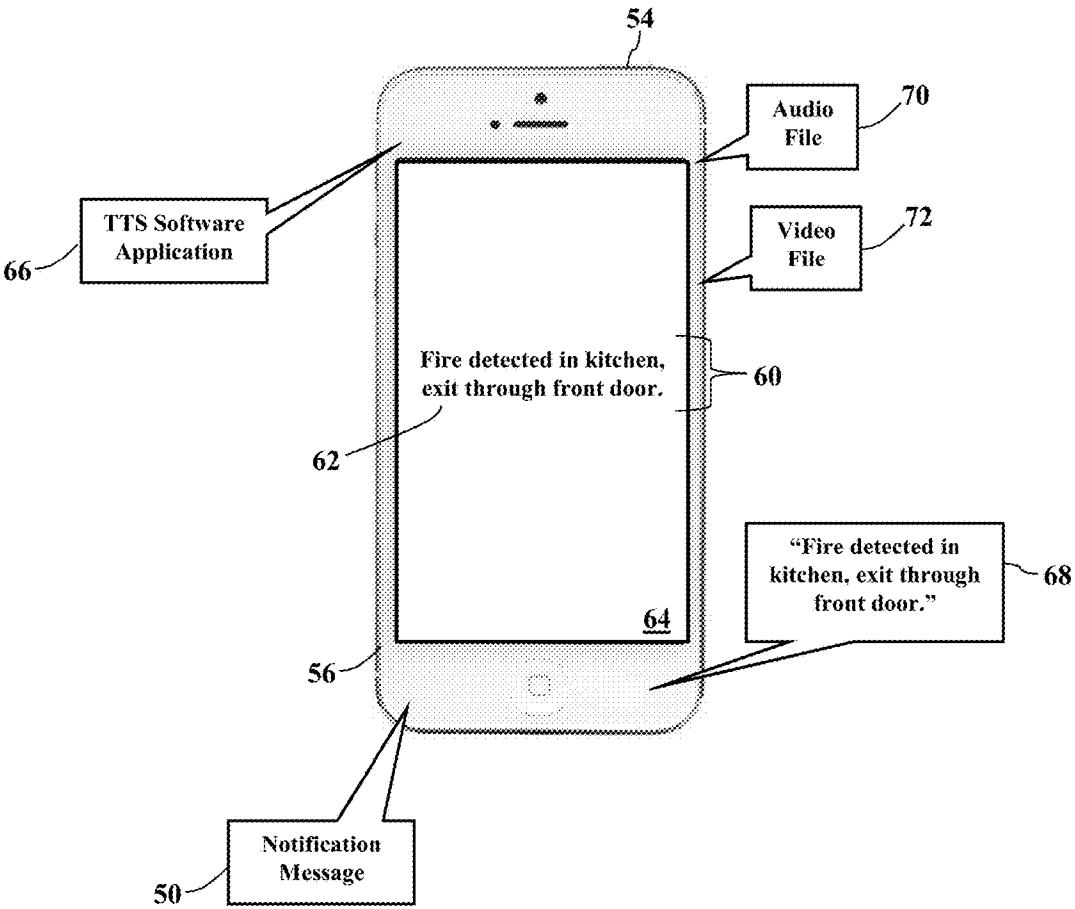

FIG. 3 illustrates the notification message 50. When the mobile smartphone 56 receives the notification message 50, the mobile smartphone 56 processes the notification message 50 for audible and/or visual presentation. For example, the smartphone 56 may display the predetermined text 60 on its display device 64. However, the smartphone 56 may also audibly speak the predetermined text 60. That is, the smartphone 56 may store and execute a text-to-speech ("TTS") software application 66 that converts the predetermined text 60 to a voice announcement 68 (such as "Fire detected in kitchen, exit through front door" or "Intruder Detected in Basement"). However, the notification message 50 may also cause the smartphone 56 to retrieve and play an audio file 70 and/or a video file 72. The audio file 70 and the video file 72 may be prerecorded instructions related to the alarm condition 40. For example, mom and dad may prerecord the evacuation instructions 62, which are sent to the children's smartphones in times of emergencies. However, the audio file 70 and the video file 72 may also be a real time audible recording, snapshot, and/or video data associated with the alarm condition 40. Regardless, the audio file 70 and/or the video file 72 are executed to play an audio and/or video announcement 68 that describes the alarm condition 40.

Figure 4:
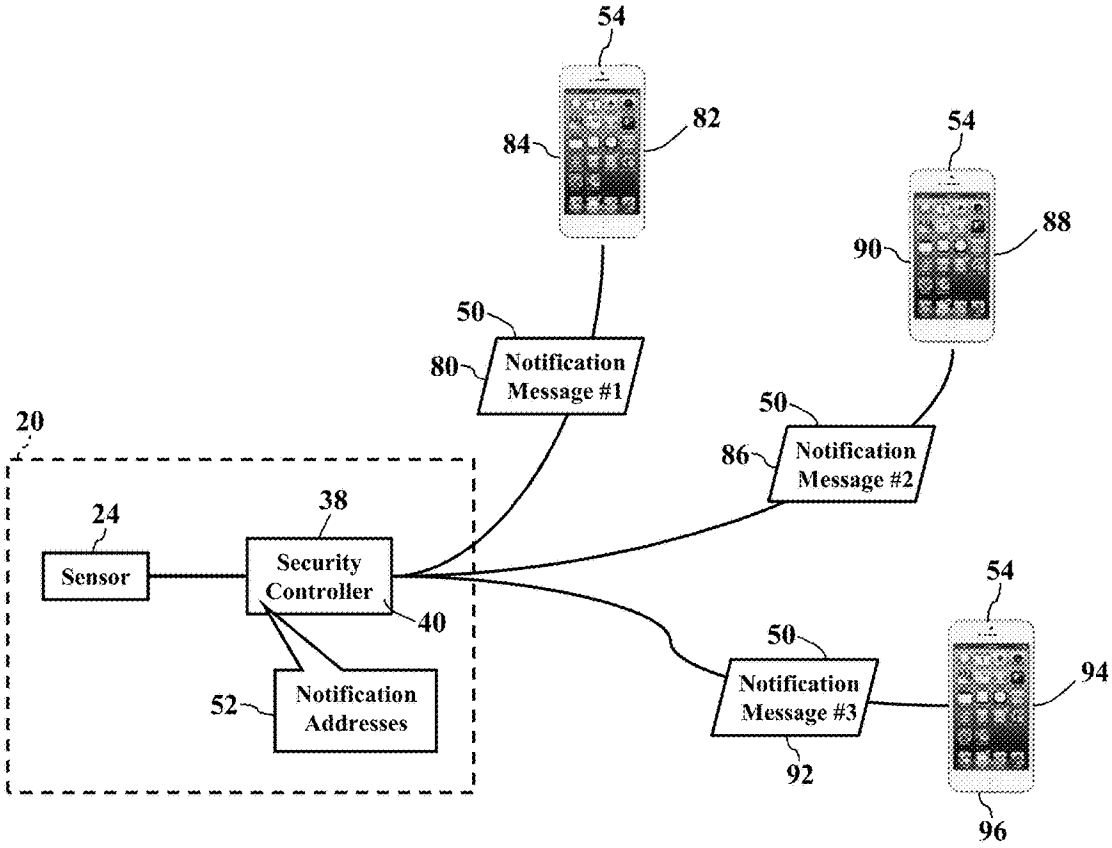

FIG. 4 further illustrates remote notifications. Here exemplary embodiments may alert multiple user devices 54 at different notification addresses 52. Exemplary embodiments may even generate and send different notification messages 50. The security system 20, for example, may send a first electronic notification message 80 to a first user device 82 associated with a first notification address 84. A different second electronic notification message 86 may be sent to a second user device 88 associated with a second notification address 90. Another different third electronic notification message 92 may be sent to a third user device 94 associated with a third notification address 96. Indeed, exemplary embodiments may remotely notify any number of devices with different personalized notification messages 50, as later paragraphs will explain. Exemplary embodiments may thus immediately alert occupants and loved ones to emergency situations.

Figure 5:
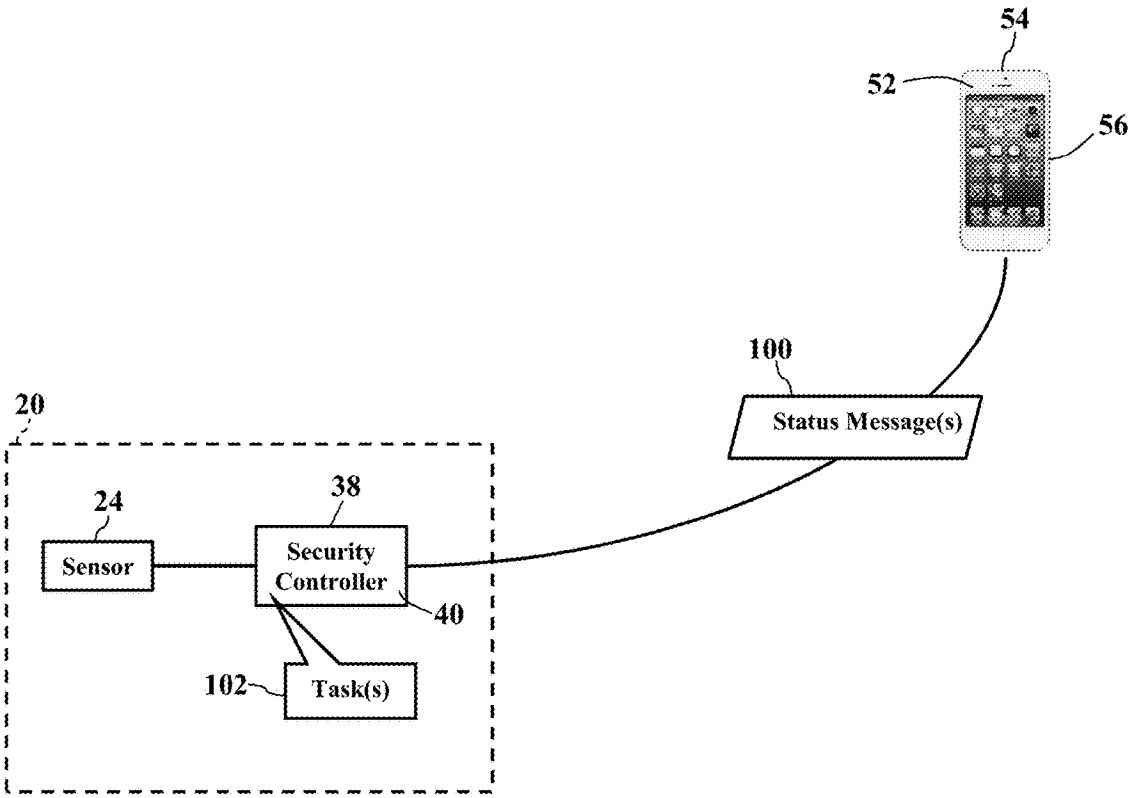

FIG. 5 illustrates processing updates. When the security system 20 determines the alarm condition 40, the security system 20 usually contacts emergency services. Sometimes, though, several seconds may pass before contact is made. For example, a cellular or telephone call may take several seconds to establish. The security system 20 may thus be programmed to send electronic status messages 100. That is, as the security system 20 performs its processing functions, the security system 20 may generate and send processing updates. For example, exemplary embodiments may define or predetermine different status messages 100 for different processing tasks 102. For example, when the security system 20 establishes contact with emergency services, the security system 20 may retrieve and send the corresponding status message 100 (such as "Central Monitoring Station Contacted"). As alarm processing continues, another status message 100 may explain the "Alarm has been Verified" or the "Police Department has been Contacted." The status messages 100 may again be sent to any of the notification addresses 52 (such as the mobile smartphone 56). When the mobile smartphone 56 receives the status message 100, the mobile smartphone 56 processes the status message 100 for audible and/or visual presentation. Exemplary embodiments may thus nearly immediately update the occupants and loved ones as help is summoned.

Figure 6:
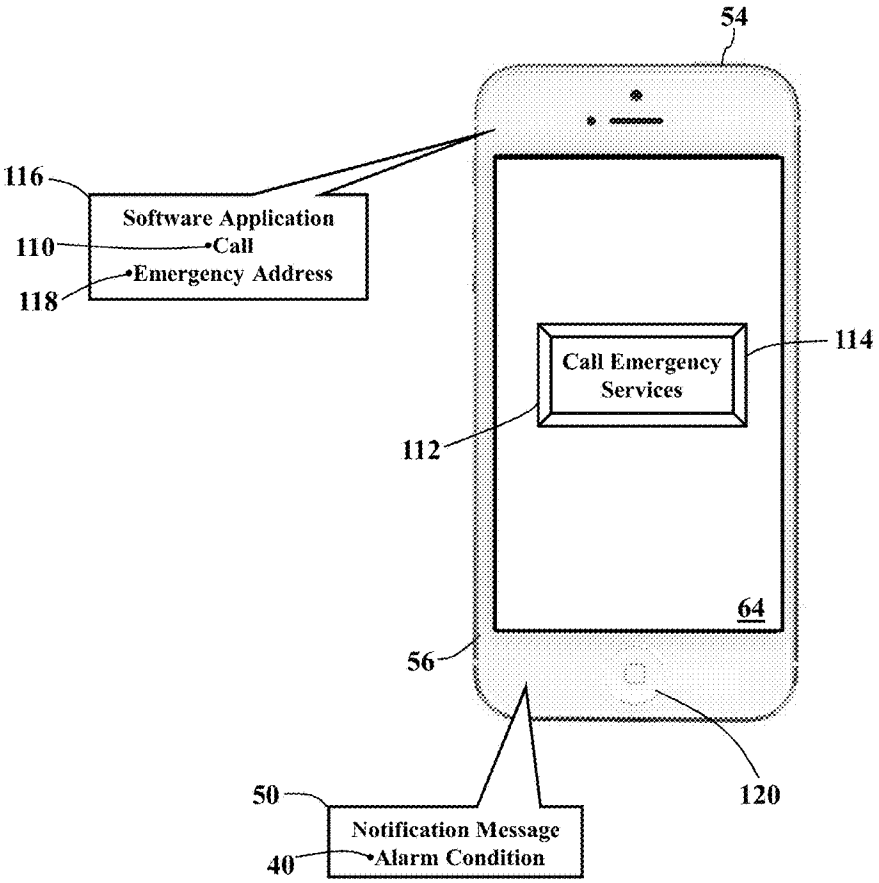

FIG. 6 illustrates call initiation. Here exemplary embodiments permit quick and simple initiation of a call 110 to emergency services. For example, when the smartphone 56 is notified of the alarm condition 40 (perhaps via the notification message 50), the mobile smartphone 56 may configure or generate a contact button 112. FIG. 6 illustrates the contact button 112 as a graphical control 114 that is displayed by the display device 64. The mobile smartphone 56 may thus store and execute a software application 116 for contacting emergency services. The user of the smartphone 56 (such as an occupant during the alarm condition 40) may merely touch or select the graphical control 114 to initiate the emergency call 110. Exemplary embodiments may alternatively or additionally reassign or reconfigure a physical button or switch (such as a home button 120) to initiate the call 110. Exemplary embodiments may thus be configured to call, text, and/or email any emergency address 118 (such as a telephone number and/or network address). The user may thus quickly contact emergency services (such as police or fire) during emergency situations.

Figure 7:
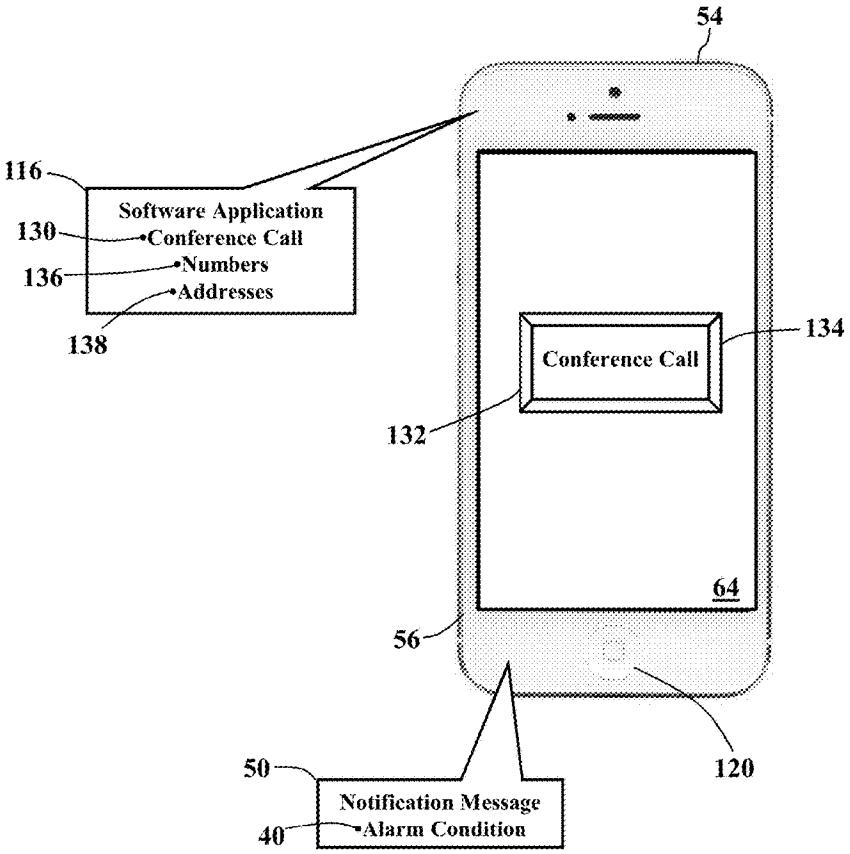

FIG. 7 illustrates emergency conferencing. Here exemplary embodiments may permit quick and simple conference calling during emergency situations. Again, when the smartphone 56 is notified of the alarm condition 40 (perhaps via the notification message 50), exemplary embodiments may automatically establish a conference call 130 with other parties. FIG. 7 illustrates the smartphone 56 displaying a conference call button 132 as another graphical control 134. When the conference call button 132 is selected, the software application 116 may be configured to automatically establish the conference call 110 with other conference participants at two (2) or more cellular telephone numbers 136 and/or network addresses 138. Suppose, for example, mom and dad have date night, and the teenagers are home alone. When mom's smartphone 56 is notified of the alarm condition 40, mom may select the conference call button 132 and nearly immediately establish the conference call 110 with the children's cellphones. Indeed, the children's cellphones may be configured to immediately answer, accept, and/or join the conference call 110. Again, then, exemplary embodiments may be preconfigured to establish the conference call 110 during emergencies.

Figure 8:
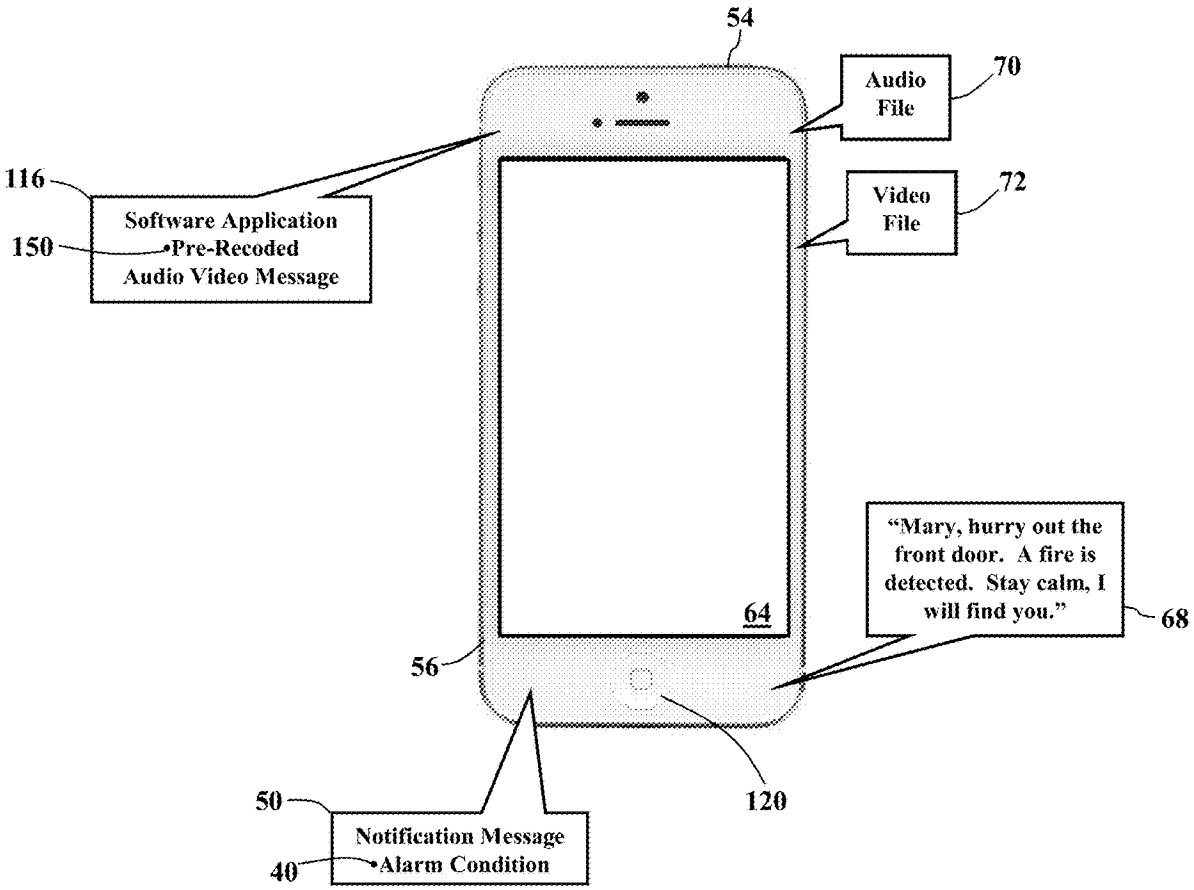

FIG. 8 illustrates personalized recordings. Here the smartphone 56 may play a pre-recorded audio video message 150 during emergency situations. Suppose a mother records the evacuation instructions 62 in her own voice. When the smartphone 56 is notified of the alarm condition 40 (perhaps via the notification message 50), exemplary embodiments may automatically retrieve and execute the corresponding audio file 70 and/or video file 72. The smartphone 56 plays mom's pre-recorded audio video message 150 in response to the notification message 50. The child is thus more likely to trust the familiar voice and quickly follow the evacuation instructions 62. The parent may thus record the evacuation instructions 62 as the audio file 70 using her smartphone 56.

Figure 9:
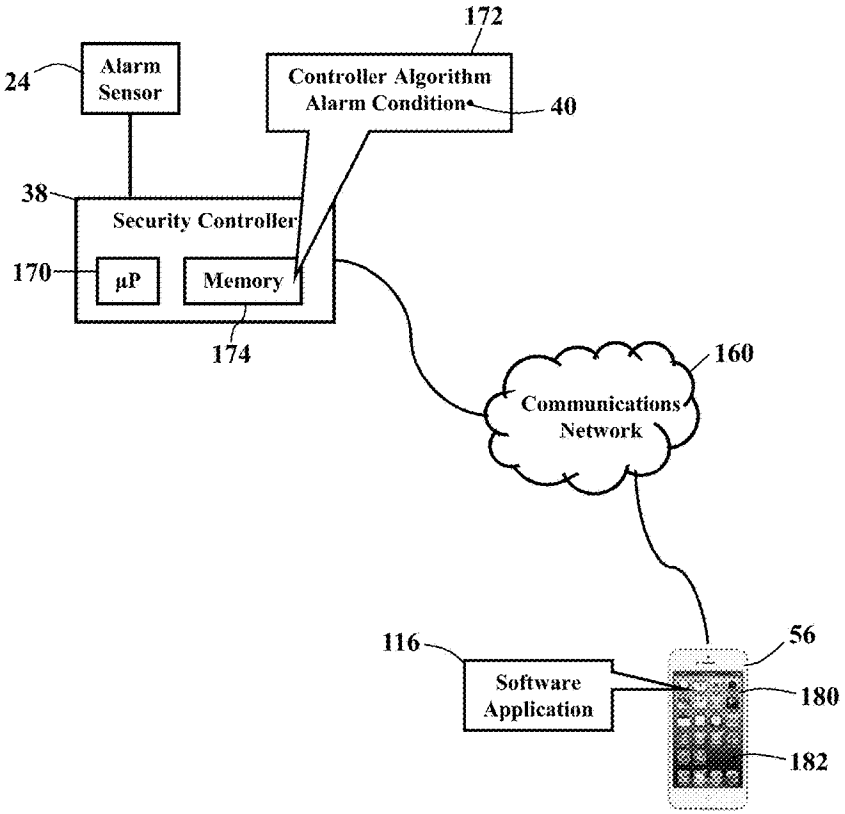
FIG. 9 is a more detailed schematic illustrating the operating environment, according to exemplary embodiments.

FIG. 9 is a more detailed schematic illustrating the operating environment, according to exemplary embodiments. The security controller 38 and the user's device 64 (such as the mobile smartphone 56) may communicate via a communications network 160. The communications network may be a wired local area network, wireless local area network (such as W-FI®), and/or a cellular data network, as later paragraphs will explain. The alarm controller 38 has a processor 170 (e.g., "μP"), application specific integrated circuit (ASIC), or other component that executes a controller algorithm 172 stored in a memory 174. The controller algorithm 172 instructs the processor 170 to perform operations, such as determining the alarm condition 40 and communicating with the smartphone 56. The smartphone 56 also has a processor 180 (e.g., "μP"), application specific integrated circuit (ASIC), or other component that executes the software application 116 stored in a memory 182. The controller algorithm 172 and the software application 116 thus cooperate to provide security services. The controller algorithm 172 and the software application 116, for example, may cooperate to configure the security controller 38 and to provide remote notification of security events, as this disclosure explains.

Exemplary embodiments may packetize. The security controller 38 and the user's device 64 have one or more network interfaces to the communications network 160. The network interface may packetize communications or messages into packets of data according to a packet protocol, such as the Internet Protocol. The packets of data contain bits or bytes of data describing the contents, or payload, of a message. A header of each packet of data may contain routing information identifying an origination address and/or a destination address. There are many different known packet protocols, and the Internet Protocol is widely used, so no detailed explanation is needed.

Exemplary embodiments may be applied regardless of networking environment. Exemplary embodiments may be easily adapted to stationary or mobile devices having cellular, WI-FI®, near field, and/or BLUETOOTH® capability. Exemplary embodiments may be applied to mobile devices utilizing any portion of the electromagnetic spectrum and any signaling standard (such as the IEEE 802 family of standards, GSM/CDMA/TDMA or any cellular standard, and/or the ISM band). Exemplary embodiments, however, may be applied to any processor-controlled device operating in the radio-frequency domain and/or the Internet Protocol (IP) domain. Exemplary embodiments may be applied to any processor-controlled device utilizing a distributed computing network, such as the Internet (sometimes alternatively known as the "World Wide Web"), an intranet, a local-area network (LAN), and/or a wide-area network (WAN). Exemplary embodiments may be applied to any processor-controlled device utilizing power line technologies, in which signals are communicated via electrical wiring. Indeed, exemplary embodiments may be applied regardless of physical componentry, physical configuration, or communications standard(s).

Exemplary embodiments may utilize any processing component, configuration, or system. Any processor could be multiple processors, which could include distributed processors or parallel processors in a single machine or multiple machines. The processor can be used in supporting a virtual processing environment. The processor could include a state machine, application specific integrated circuit (ASIC), programmable gate array (PGA) including a Field PGA, or state machine. When any of the processors execute instructions to perform "operations", this could include the processor performing the operations directly and/or facilitating, directing, or cooperating with another device or component to perform the operations.

Figure 10:
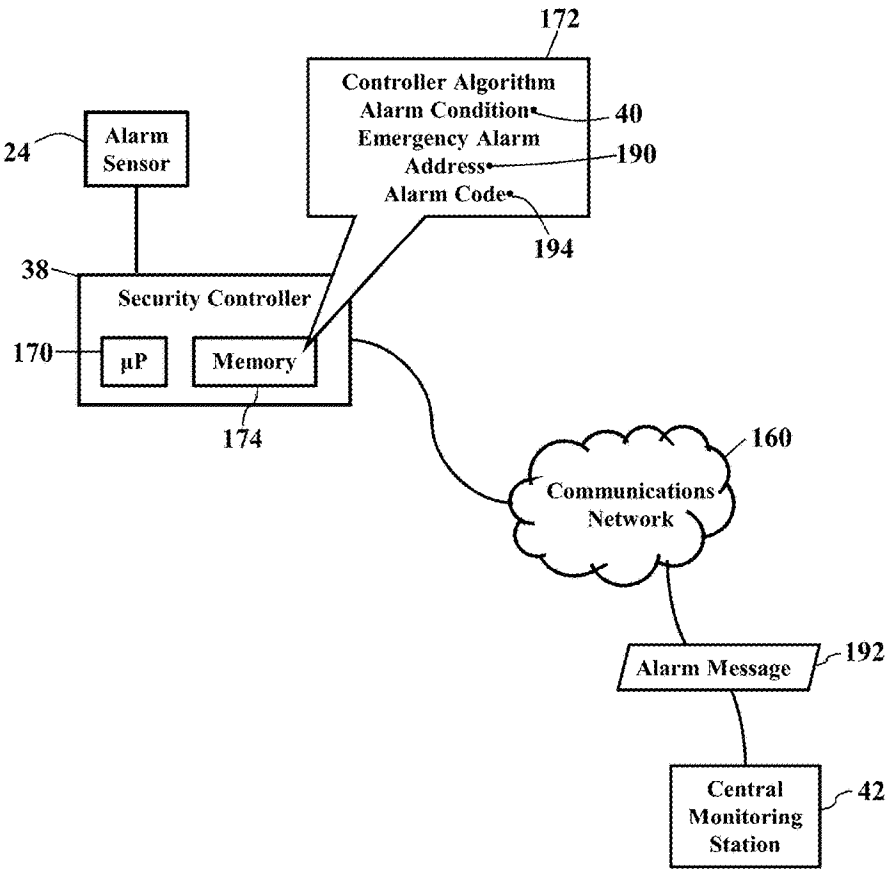
FIG. 10 illustrates centralized monitoring, according to exemplary embodiments.

FIG. 10 illustrates centralized monitoring, according to exemplary embodiments. The controller algorithm 172 causes the alarm controller 38 to monitor the inputs, outputs, status, and/or state of the alarm sensors 24. When the controller algorithm 172 determines the alarm condition 40, the controller algorithm 172 instructs the processor 150 to notify the central monitoring station 42. That is, the security controller 38 retrieves an emergency alarm address 190 associated with the central monitoring station 42. The emergency alarm address 190 is a network communications address at which the central monitoring station 42 receives alarm messages from customers or subscribers of an alarm monitoring service. The controller algorithm 172 generates and sends an alarm message 192 to the emergency alarm address 190. The alarm message 192 includes data that describes the alarm condition 40, such as an alarm code 194 and/or an identifier of alarm sensor 24 detecting an abnormal measurement or reading. The alarm message 192 may also include information uniquely describing the security system 20, such as an Internet Protocol address assigned to the alarm controller 38. The alarm message 192 is routed into the communications network 160 (such as a private cellular data network and/or a private data network) for delivery to the emergency alarm address 190. The alarm message 192 may thus be packetized according to a packet protocol (such as the IPv4 or IPv6 protocols). When a server associated with the central monitoring station 42 receives the alarm message 192, the central monitoring station 42 may contact emergency services, as is known.

Figure 11:
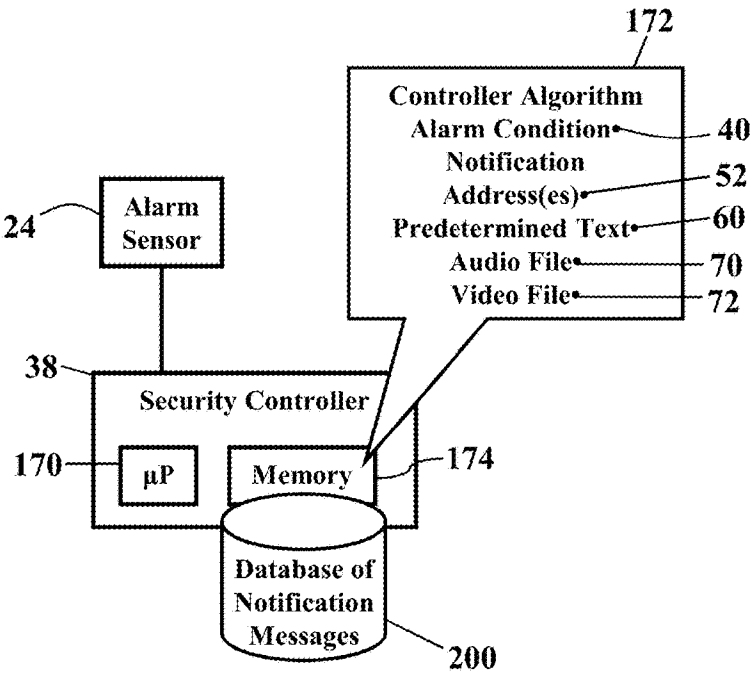
Figure 13:
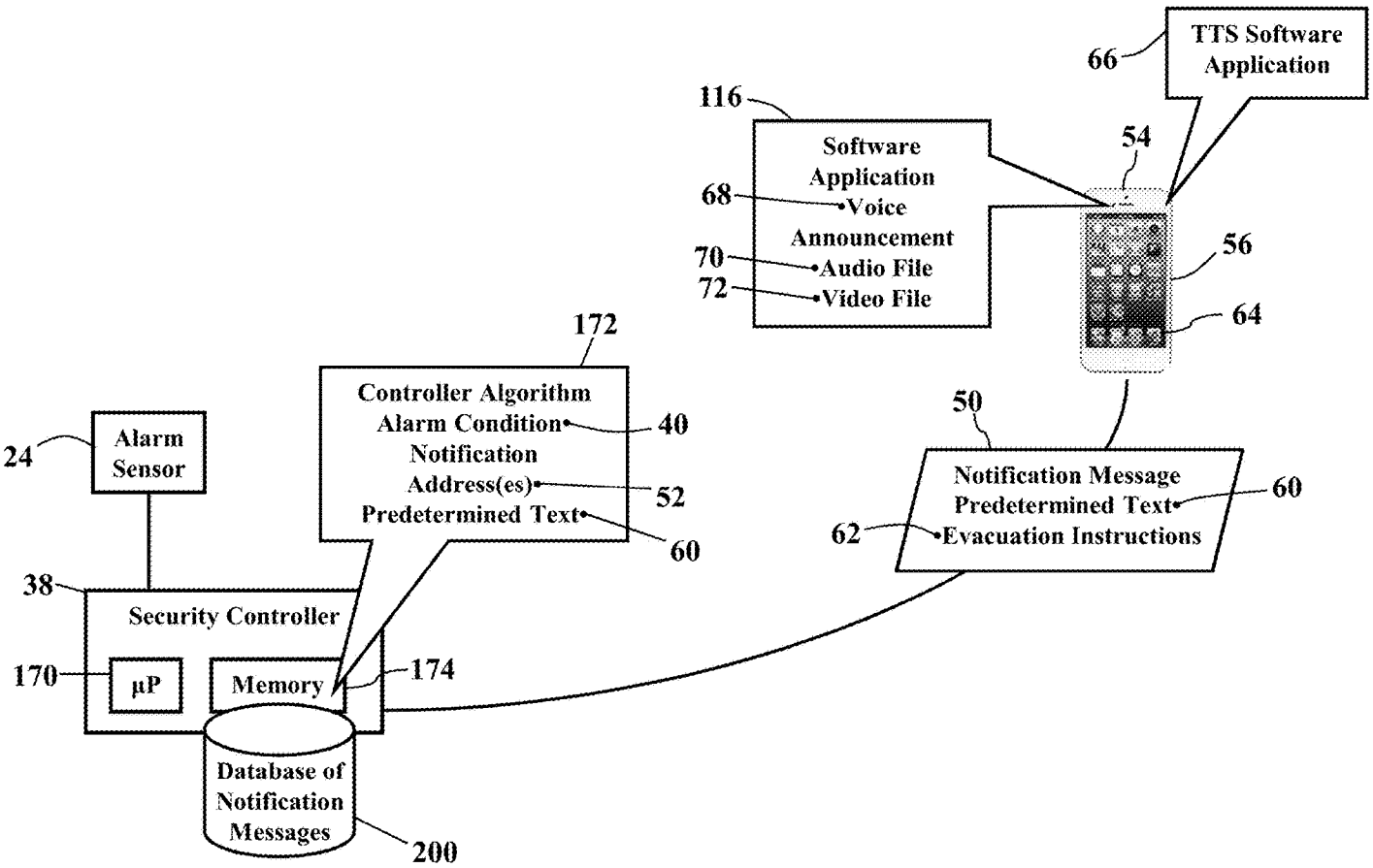

FIGS. 11-13 illustrate personal notifications, according to exemplary embodiments. When the security controller 38 determines the alarm condition 40, exemplary embodiments may notify occupants, family members, and friends. FIG. 11, for example, illustrates a database 200 of notification messages. When the controller algorithm 172 determines the alarm condition 40, the controller algorithm 172 may cause the security controller 38 to query the database 200 of notification messages for the alarm condition 40. FIG. 11 illustrates the database 200 of notification messages as being locally stored in the memory 174 of the security controller 38, yet the database 200 of notification messages may be remotely stored at some other network location. The security controller 38 retrieves the corresponding notification addresses 52 that are associated with the alarm condition 40. The security controller 38 may also retrieve the predetermined text 60, the audio file 70, and/or the video file 72 that are associated with the alarm condition 40.

FIG. 12 illustrates electronic database associations. The database 200 of notification messages is illustrated as a table 202 that maps, relates, or associates different alarm conditions 40 to different notification addresses 52. Each alarm condition 40 may be defined by one or more identifiers of the alarm sensors 24 detecting abnormal readings or measurements. Each alarm condition 40 may additionally or alternatively be defined by one or more alarm codes 194 representing the alarm sensors 24 detecting abnormal readings or measurements. Regardless, the security controller 38 queries the database 200 of notification messages for the alarm condition 40 and retrieves the corresponding notification addresses 52 having electronic database associations with the alarm condition 40. The security controller 38 may also retrieve the predetermined text 60, the audio file 70, and/or the video file 72 having one or more electronic database associations with the alarm condition 40.

FIG. 13 illustrates the notification message 50. Once the notification addresses 52 are determined (based on the alarm condition 40), the controller algorithm 172 instructs the security controller 38 to generate the notification message 50 containing or describing the predetermined text 60, the audio file 70, and/or the video file 72. The security controller 38 sends the notification message 50 to each notification address 52 retrieved from the database 200 of notification messages. The notification message 50 may be sent using a local area network (such as a WI-FI® network) or a wide area network (cellular data network or wireless cable/DSL). While the notification message 50 may be sent to any device associated with any notification address 52, FIG. 13 again illustrates the mobile smartphone 56. When the mobile smartphone 56 receives the notification message 50, the mobile smartphone 56 processes the notification message 50 for audible and/or visual presentation. For example, the smartphone 56 may display the predetermined text 60 on its display device 64. However, the smartphone 56 may also execute the text-to-speech ("TTS") software application 116 that converts the predetermined text 60 to the voice announcement 68 (such as "Fire Detected in Kitchen" or "Intruder Detected in Basement"). The smartphone 56 may also retrieve, process, and play the audio file 70 and the video file 72. The user of the smartphone 56 is thus nearly immediately informed of the alarm condition 40 detected by the security system 20.

The notification message 50 may have any format. The notification message 50 may be electronically sent as a Short Message Service text message. The notification message 50 may also be electronically sent as an email. However, the notification message 50 may also be electronically posted to a webpage or website, such as a social network associated with the notification address 52 and/or the user of the smartphone 56.

Figure 14:
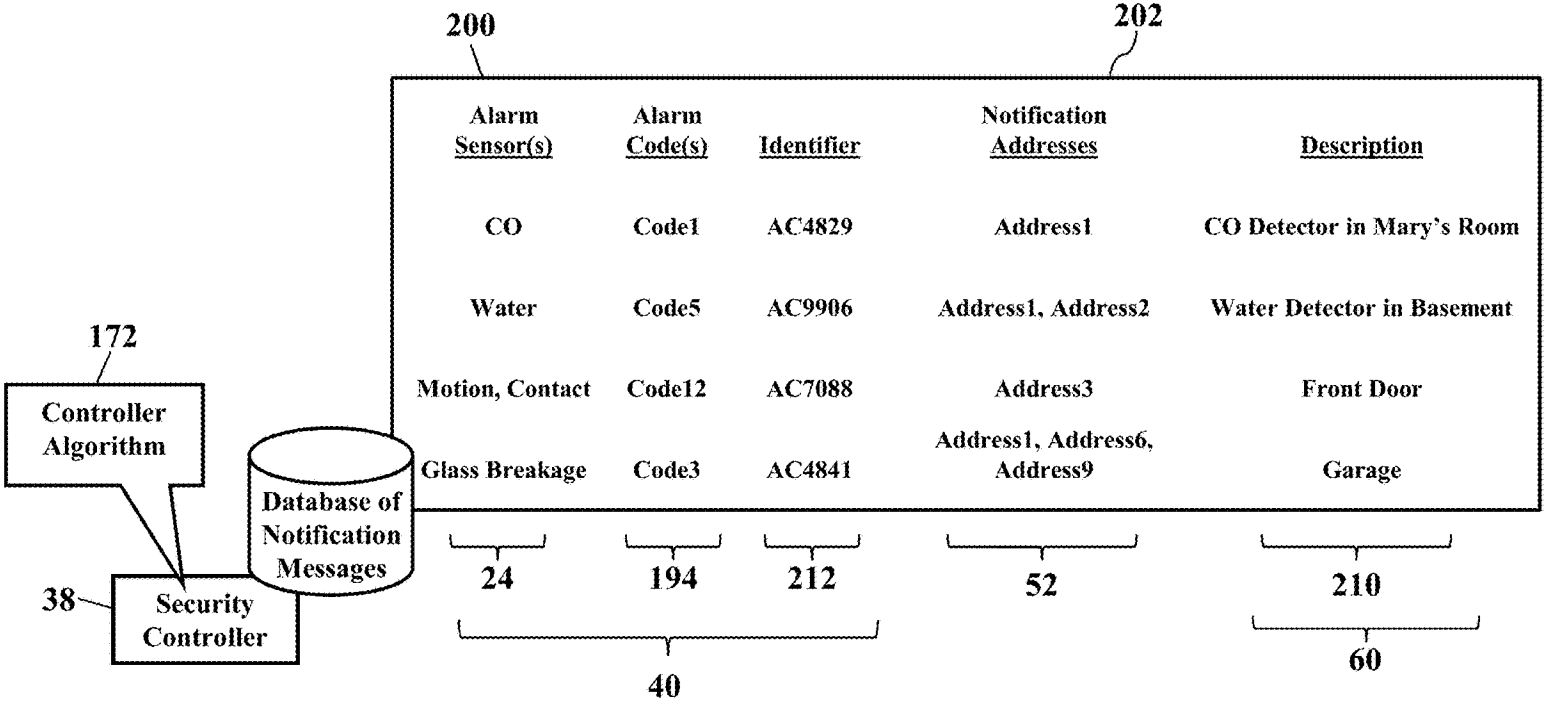
FIGS. 14-16 further illustrate personal notifications, according to exemplary embodiments.
Figure 15:
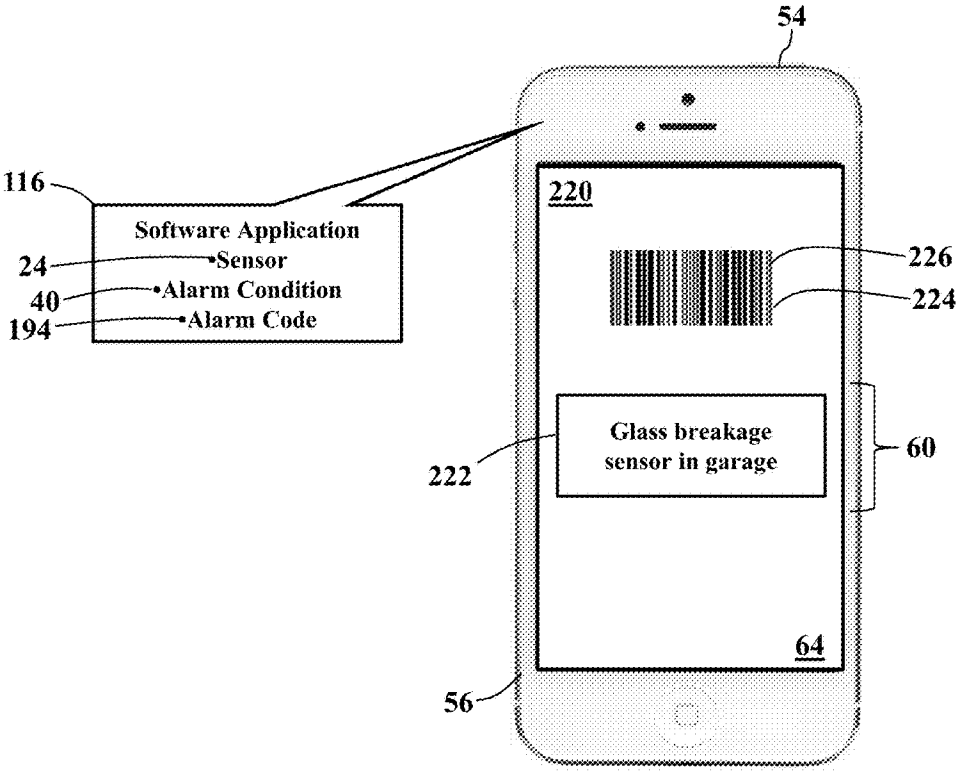
Figure 16:
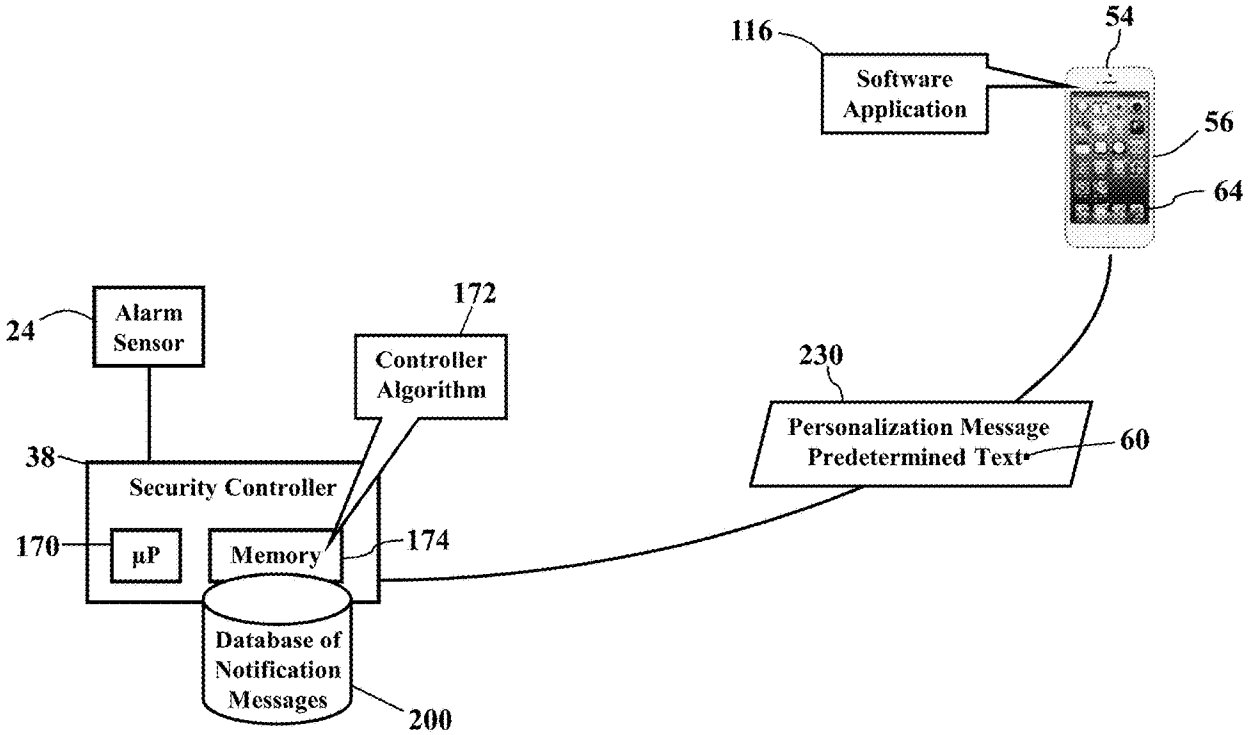

FIGS. 14-16 further illustrate personal notifications, according to exemplary embodiments. Here the database 200 of notification messages may contain even more personalizations. As FIG. 14 illustrates, the database 200 of notification messages may have additional entries further defining the predetermined text 60 for different alarm conditions 40. Each alarm condition 40 may have a corresponding textual description 210. Most alarm conditions 40 are identified by an alphanumeric identifier 212. As the reader may understand, the alarm condition "AC4829" is meaningless to most recipients. Exemplary embodiments, though, permit the user to augment the database 200 of notification messages with the personalized textual description 210. The user may thus add the textual description 210 to provide a personal, detailed explanation of the alarm condition 40. So, when the security controller 38 determines the alarm condition 40, the controller algorithm 172 may query the database 200 of notification messages for the alarm condition 40 and retrieve the corresponding textual description 210. The user may thus configure the database 200 of notification messages to provide the meaningful textual description 210 of each different alarm condition 40. Exemplary embodiments thus resolve the alarm condition "AC4829" into "CO Detector in Mary's Room." When the notification message 50 is sent, the smartphone 56 may thus display and/or announce the "CO Detector in Mary's Room" is detecting an abnormal reading.

FIG. 15 illustrates remote configuration. Here the user may use her smartphone 56 to add the predetermined text 60 to the database 200 of notification messages. Recall that the smartphone 56 executes the software application 116 that cooperates with the controller algorithm 172. The software application 116, for example, may cause the smartphone 56 to generate a graphical user interface 220 for display by the display device 64. The graphical user interface 220 may display a data field 222 for entering the predetermined text 60. For example, the user may type (using a capacitive touch screen) the textual description 210 associated with any sensor 24, alarm condition 40, and/or alarm code 194 in the home or business. Suppose, for example, the smartphone 56 optically reads a barcode 224 that is adhered to or printed on the sensor 24. That is, the user commands or instructs the user to capture an image or scan 226 of the barcode 224. The barcode 224 uniquely identifies the sensor 24. The user may then enter her personalized, predetermined text 60 into the data field 222 that explains the barcode 224. While the user may add any explanation or description she desires, FIG. 15 illustrates a textual description of a location associated with the sensor 24.

FIG. 16 illustrates a personalization message 230. Once the user completes her personalized, predetermined text 60, the smartphone 56 may sent the electronic personalization message 230 to the network address associated with the security controller 38. The personalization message 230 includes information or data describing the user's predetermined text 60 and the alarm sensor 24, the alarm condition 40, and/or the alarm code 194. When the security controller 38 receives the personalization message 230, the controller algorithm 172 may cause the processor 170 to add entries to the database 200 of notification messages that electronically associate the predetermined text 60 to the corresponding alarm sensor 24, the alarm condition 40, and/or the alarm code 194. The entries may also associate information associated with the user and/or her account, such as the cellular number/identifier of the smartphone 56 and/or the Internet Protocol address associated with the security controller 38.

Figure 17:
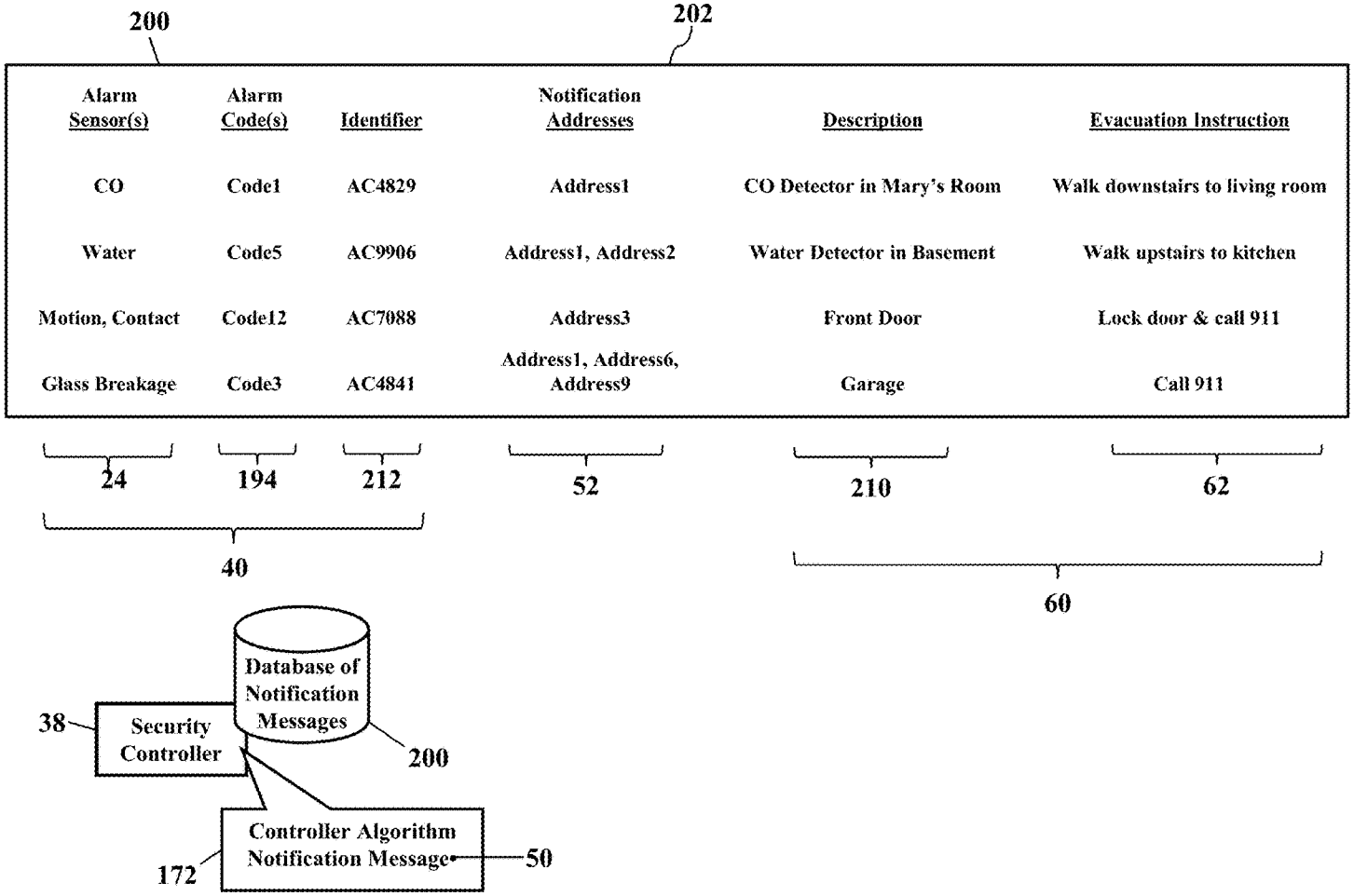
FIG. 17 illustrates evacuation instruction, according to exemplary embodiments.

FIG. 17 further illustrates the evacuation instructions 62, according to exemplary embodiments. Here exemplary embodiments permit user-defined evacuation routes, safety instructions, and other emergency text. As FIG. 17 illustrates, the database 200 of notification messages may contain additional entries further defining the predetermined text 60 for the different alarm conditions 40. For example, the user may define the personal evacuation instructions 62 for each recipient of the notification message 50. Suppose, for example, mom and dad want the child's smartphone 56 to repeatedly announce "Climb Out the Window" during a fire. Mom and dad may thus personalize the database 200 of notification messages with the evacuation instruction 62. That is, the database 200 of notification messages is configured with electronic database associations between the child's notification address 52 and the predetermined text 60. Whenever the alarm condition 40 indicates smoke or heat, the corresponding notification address 52 receives the corresponding evacuation instruction 62 (i.e., "Climb Out the Window").

FIG. 17 also illustrates different evacuation instructions 62. As the reader may understand, there may be many different evacuation paths from the home or business, depending on the emergency. An intruder in the basement, for example, likely has a different evacuation route than a high carbon monoxide detection in an upstairs bedroom. Exemplary embodiments thus permit personalization with different evacuation instructions 62 for different emergency situations. That is, the database 200 of notification messages may be configured with electronic database associations between different alarm conditions 40 and different evacuation instructions 62. When the security system 20 determines the alarm condition 40, the controller algorithm 172 queries the database 200 of notification messages for the alarm condition 40 and retrieves the corresponding evacuation instruction 62. The user may thus configure the database 200 of notification messages to provide a path to safety during different sensory conditions. The recipient of the notification message 50 thus reads or hears the evacuation instruction 62 that corresponds to the alarm condition 40. A residential or business user may thus define different evacuation paths from different rooms in the home or business, depending on the triggering alarm sensor 24 and/or alarm condition 40.

Figure 18:
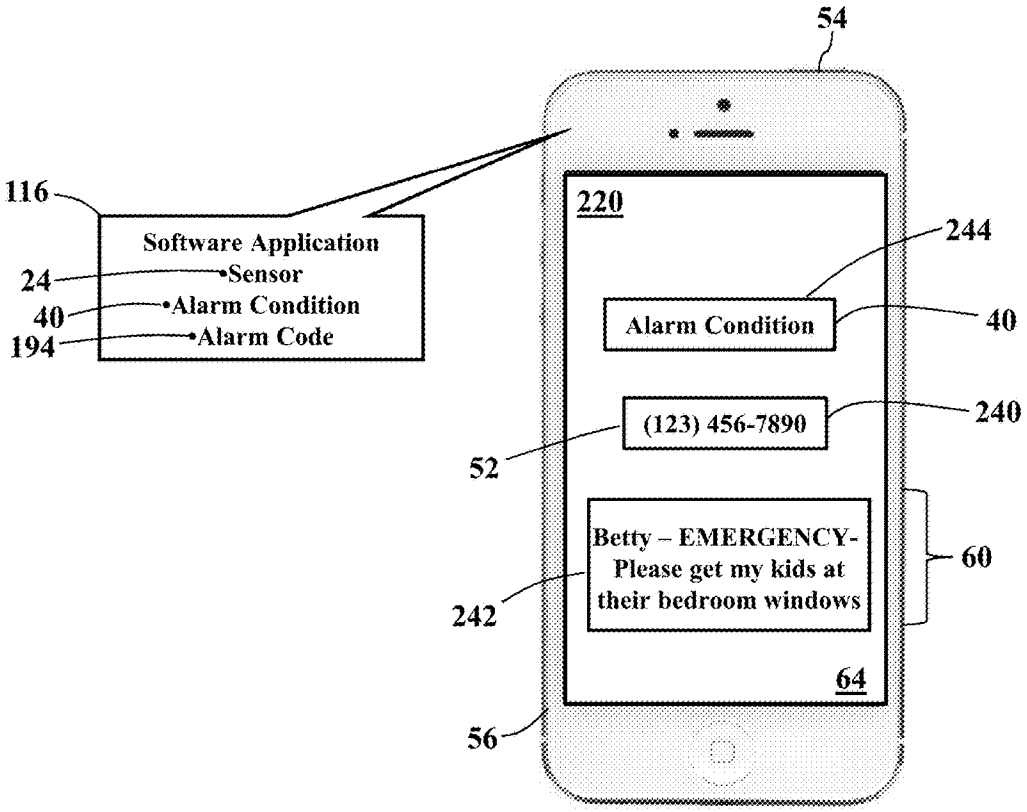
FIG. 18 further illustrates personal notifications, according to exemplary embodiments.

FIG. 18 further illustrates personal notifications, according to exemplary embodiments. This disclosure explains how occupants, family members, and friends may be remotely notified during emergency situations. Yet different recipients may receive different remote notifications, depending on the entries in the database 200 of notification messages. That is, the database 200 of notification messages may store electronic database associations between different alarm conditions 40, different notification addresses 52, and different predetermined text 60. Exemplary embodiments may thus personalize remote notification based solely on the alarm condition 40, without having to determine a current location of the smartphone 56.

FIG. 18 again illustrates the graphical user interface 220. The graphical user interface 220 may display an address data field 240 in which the user enters the desired notification address(es) 52. The graphical user interface 220 may also display a text data field 242 in which the user types the corresponding predetermined text 60. The graphical user interface 220 may also display the corresponding alarm condition 40 in an alarm data field 244. The user types the desired notification address(es) 52 and the desired predetermined text 60. Suppose heat, smoke, and/or carbon monoxide indicate the alarm condition 40 associated with a fire. The children's smartphones may receive the evacuation instructions 62, perhaps personalized according to the children's respective ages, bedroom locations, and the location of the fire (e.g., alarm sensor 24 locations). A neighbor's smartphone, though, may receive "Betty—EMERGENCY—Please get my kids at their bedroom windows." Grandma's and grandpa's smartphones may receive "Fire detected in family room—will call later." So, not only will exemplary embodiments quickly notify fire, police, and other emergency personnel, but exemplary embodiments may also notify loved ones and friends for additional help.

Geographic location need not be considered. When an emergency occurs in the home or business, local occupants are the overriding concern. That is, people in the home or office building are the priority for remote notification. If the smartphone 56 has GPS coordinates miles away, the user is presumably safe from the emergency. Exemplary embodiments may thus only retrieve and send the evacuation instructions 62 to those in harm's way. The security controller 38 may thus maintain a connectivity log of WI-FI® service. The security controller 38 may have a WI-FI® or other wireless local area network transceiver that acts as an access point to a wireless network. If any one of the remote notification addresses 52 is currently registered to the WI-FI® network, the controller algorithm 172 may prioritize the evacuation instructions 62 to those notification addresses 52 being served or reachable via the WI-FI® network. The controller algorithm 172 may thus disregard or delay sending the evacuation instructions 62 to any notification addresses 52 not reachable via the WI-FI® network.

Figure 19:
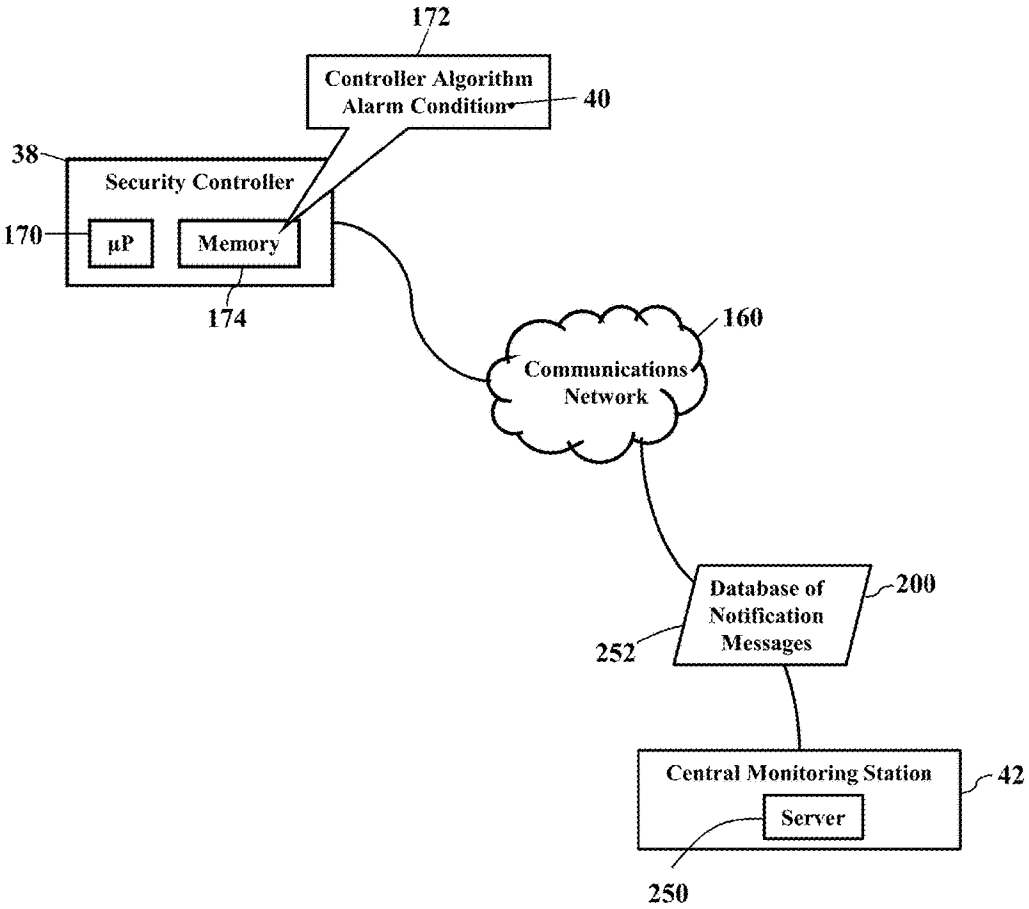
FIG. 19 illustrates centralized remote verification, according to exemplary embodiments.

FIG. 19 illustrates centralized remote verification, according to exemplary embodiments. Here a central server 250 may manage remote notification of family and friends during emergency situations. Sometimes an emergency situation may eventually disable the security controller 38. For example, even though the security controller 38 may initially determine the alarm condition 40, at some point the security controller 38 may succumb to an operational failure, especially during a fire, earthquake, flood, or other severe destructive event. Exemplary embodiments, then, may maintain a duplicate copy 252 of the database 200 of notification messages at a remote location, such as the central server 250 operating in or associated with the central monitoring station 42. The central server 250, in other words, may remotely store a backup copy 252 of the user's personalizations. Should the security controller 38 fail to respond to any message from the central monitoring station 42, exemplary embodiments may assume the security controller 38 has succumbed to failure. The central monitoring station 42 may thus retrieve the backup copy 252 of the user's personalizations from the central server 250 and continue executing the user's remote notifications. The backup copy 252 of the user's database 200 of notification messages may thus be electronically associated with the security controller 38 (perhaps according to account information, such as the unique IP address assigned to the security controller 38). The central monitoring station 42 may thus resume sending the user's personalized notification messages.

Figure 20:
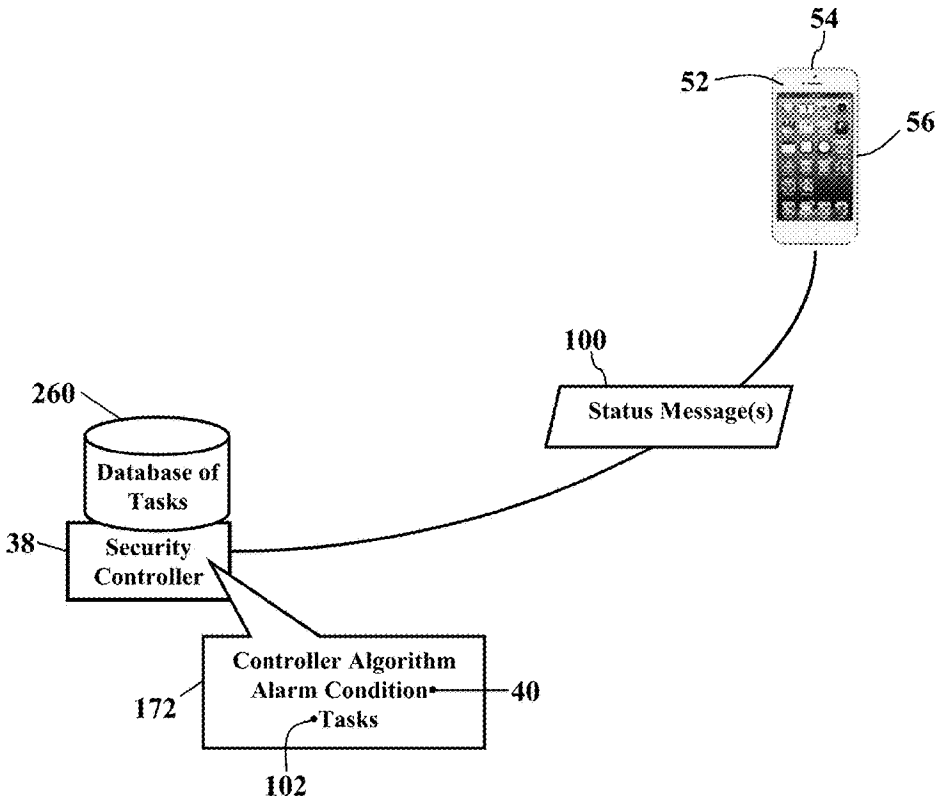
FIG. 20 illustrates processing updates, according to exemplary embodiments.

FIG. 20 illustrates processing updates, according to exemplary embodiments. As this disclosure previously explained, exemplary embodiments may provide the status messages 100. The status messages 100 provide reassuring updates as emergency services are summoned, travel, and arrive. When the security controller 38 determines the alarm condition 40, the controller algorithm 172 may query an electronic database 260 of tasks for the alarm condition 40. The database 260 of tasks stores different processing tasks 102 or events for different alarm conditions 40. For example, again suppose heat, smoke, and/or carbon monoxide readings indicate the alarm condition 40 associated with a fire. The controller algorithm 172 queries the electronic database 260 of tasks and retrieves the one or more tasks 102 having an electronic database association with the alarm condition 40. The tasks 102 may be chronologically and/or sequentially arranged whenever a fire is detected. For example, the initial tasks 102 may prioritize notification of minor children in the home (perhaps using the notification messages 50, as explained with reference to FIGS. 2-4). At some point fire, police and other emergency services are summoned (such as "Central Monitoring Station Contacted"). As alarm processing continues, another status message 100 may explain the "Alarm has been Verified" or the "Police Department has been Contacted." Later messages may explain "Police are 1 mile away" and then "Police arrived." Moreover, additional processing tasks 102 may require further safety precautions, such as "Natural gas shut off" and "Electric service disconnected." Exemplary embodiments may thus update any one or more notification addresses 52 as any entry in a listing of the tasks is processed from start to completion/finish.

Figure 21:
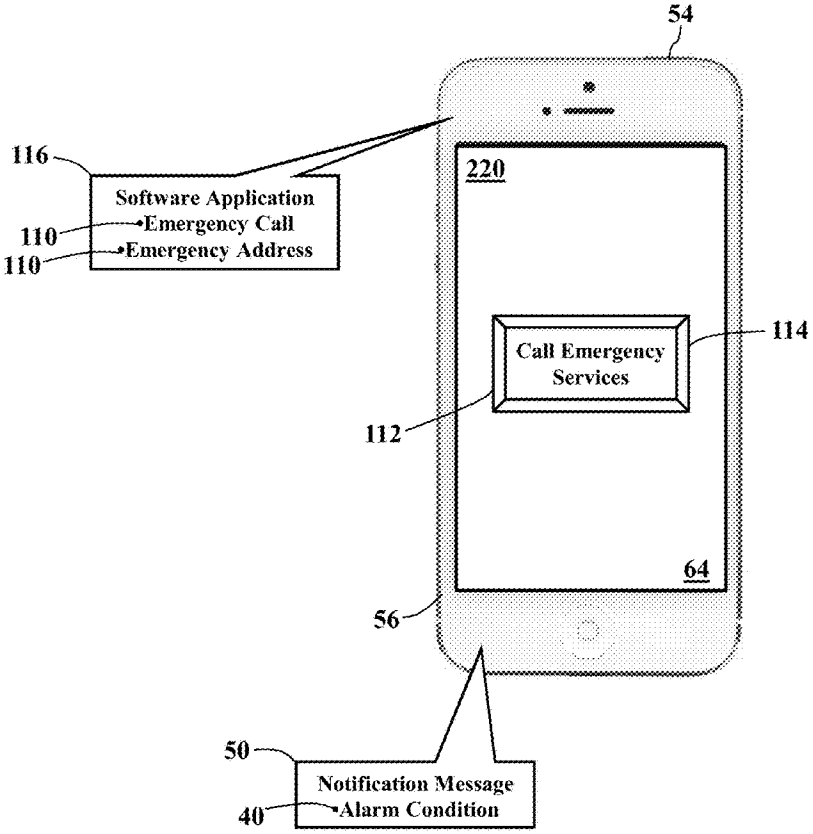
FIG. 21 illustrates call initiation, according to exemplary embodiments.

FIG. 21 further illustrates call initiation, according to exemplary embodiments. Here exemplary embodiments permit quick and simple initiation of the call 110 to emergency services. That is, suppose the software application 116 receives the notification message 50 describing the alarm condition 40. The software application 116 may instruct the smartphone 56 to generate the graphical user interface 220 displaying the graphical control 114 as the emergency contact button 112. The software application 116 may thus be pre-configured for contacting emergency services at the emergency address 118 (such as a telephone number and/or network address). When the user of the smartphone 56 touches or selects the graphical control 114, the software application 116 initiates the emergency call 110. Exemplary embodiments may alternatively or additionally reassign or reconfigure a physical button or switch (such as a home button 120) to initiate the call 110. The user may thus quickly contact emergency services (such as police or fire) during emergency situations. Call initiation and setup are well known and need not be further described.

Figure 22:
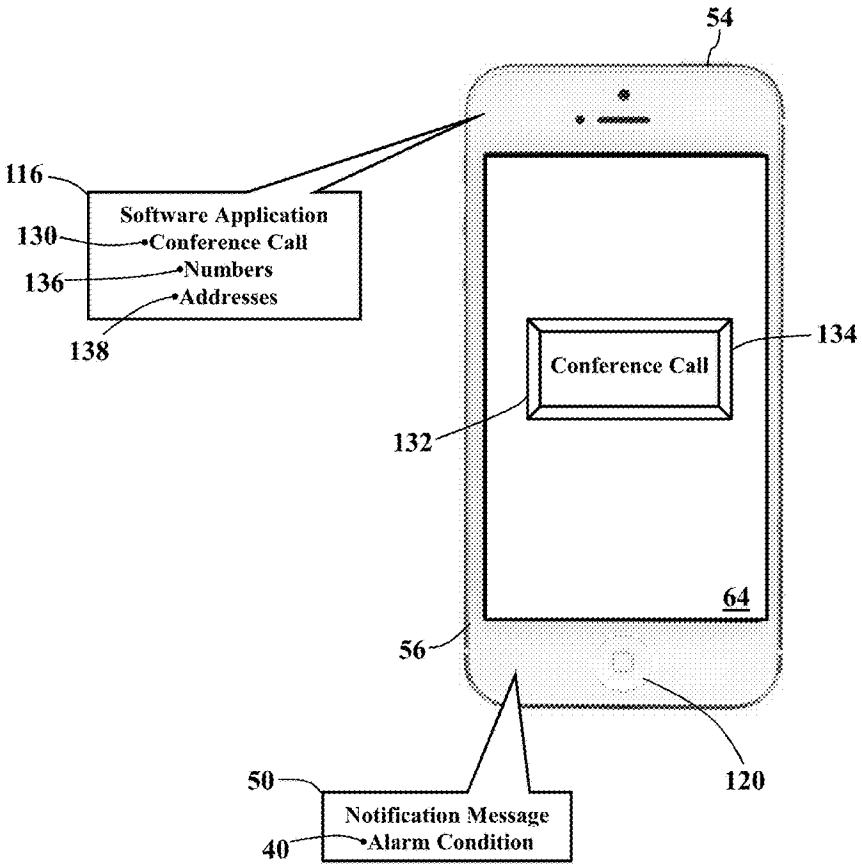
FIGS. 22-24 further illustrate emergency conferencing, according to exemplary embodiments.
Figure 23:
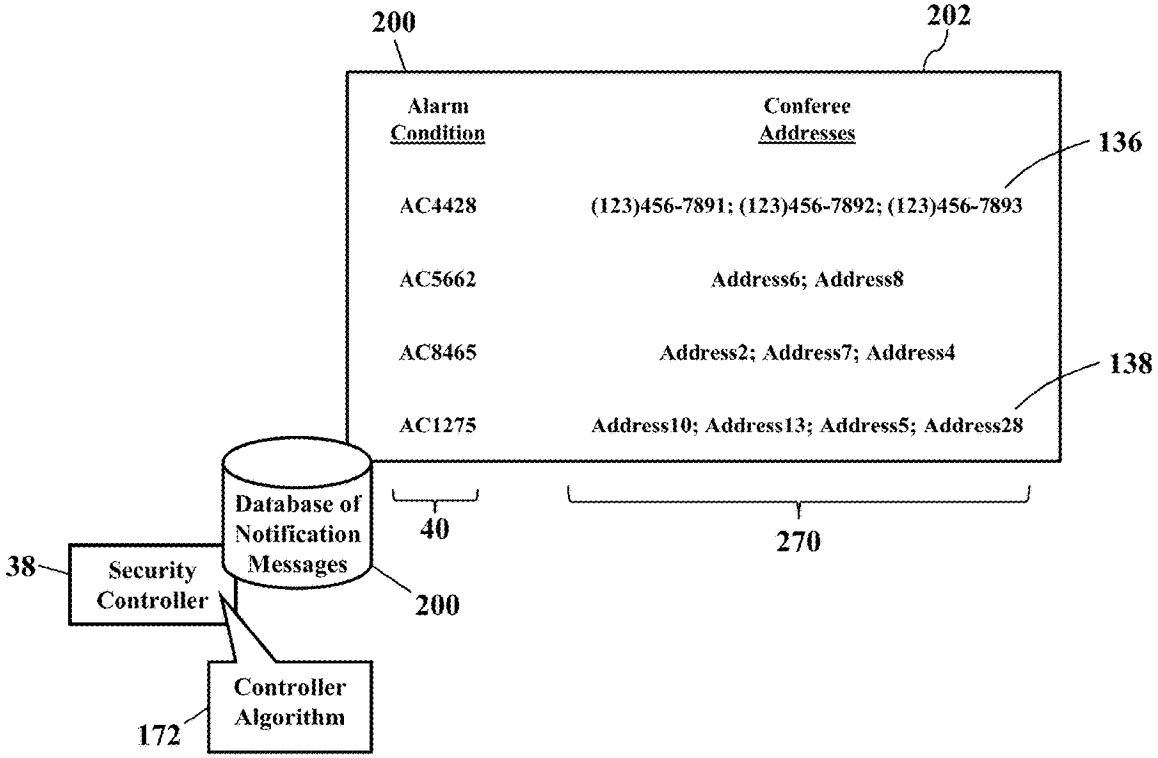
Figure 24:
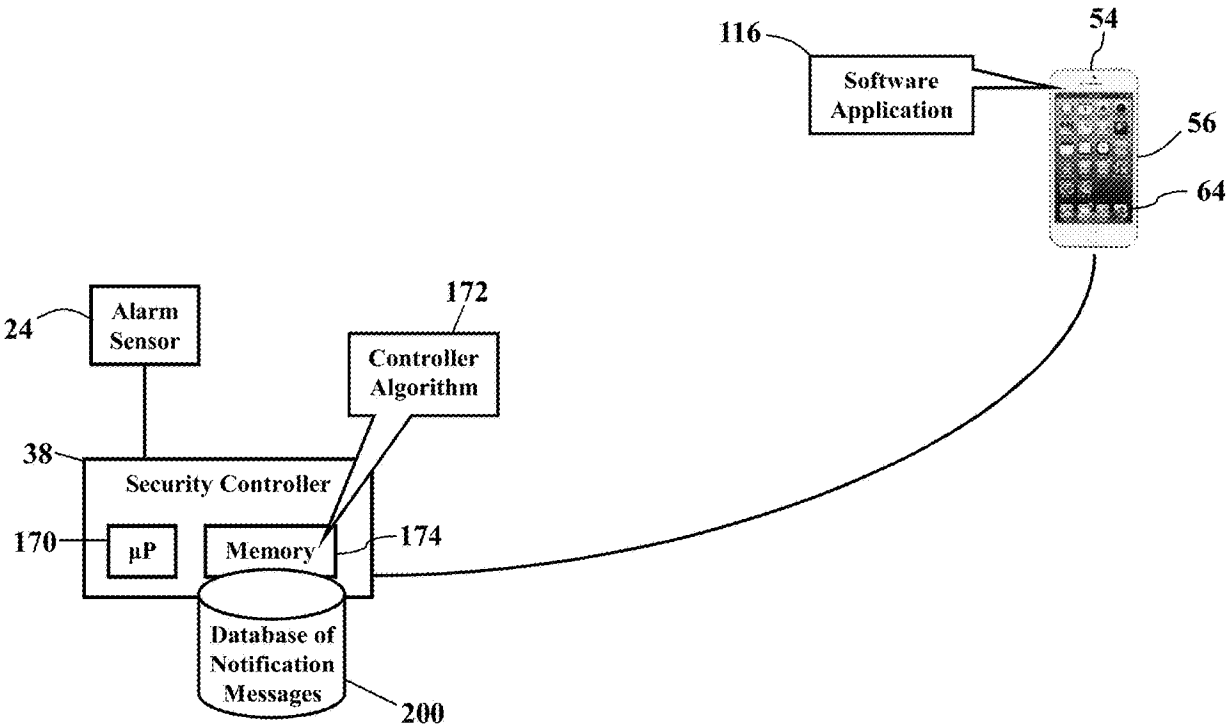

FIGS. 22-24 further illustrate emergency conferencing, according to exemplary embodiments. When the software application 116 receives the notification message 50, the software application 116 may establish the conference call 130 with other parties. The user of the smartphone 56 may thus confer with loved ones during emergency situations, especially young children in the home. FIG. 22 thus again illustrates the graphical user interface 220 displaying the conference call button 132 as the graphical control 134. When the user touches or selects the conference call button 132, the software application 116 may be configured to automatically establish the conference call 110 with other conference participants at two (2) or more cellular telephone numbers 136 and/or network addresses 138. A parent's smartphone 56 may thus nearly immediately establish the conference call 110 with the children's cellphones. Indeed, the children's cellphones may be configured to immediately answer, accept, and/or join the conference call 110. Again, then, exemplary embodiments may be preconfigured to establish the conference call 110 during emergencies. Conference calling is well known and need not be further described.

FIGS. 23-24 illustrate conferencing configuration. Here the user may configure the database 200 of notification messages to define different conferees 270 for different alarm conditions 40. Recall that each alarm condition 40 may be defined by any single or combination of alarm sensors 24, the alarm conditions 40, and/or the alarm codes 194 (as illustrated with reference to FIGS. 14 & 17). Database entries may thus also be defined that associated the alarm condition 40 to the telephone numbers 136 and/or network addresses 138 for the corresponding conference call 110. Once the user configures the conferees 270 for any alarm condition 40, the security controller 38 may send or push those configurations to the user's smartphone 56. database 200 of notification messages. For example, FIG. 24 again illustrates the personalization message 230. Here, though, the security controller 38 may send the personalization message 230 to the network address 64 associated with the user's smartphone 56. The personalization message 230 includes data or information describing the user's desired conferees 270 for each different alarm condition 40. When the smartphone 56 receives the personalization message 230, the software application 116 reads the user's different conferees 270 for each different alarm condition 40. So, should the user then select the conference call button 132 (perhaps at receipt of the notification message 50), exemplary embodiments automatically establish the conference call 110 using the corresponding conferees 270.

Figure 25:
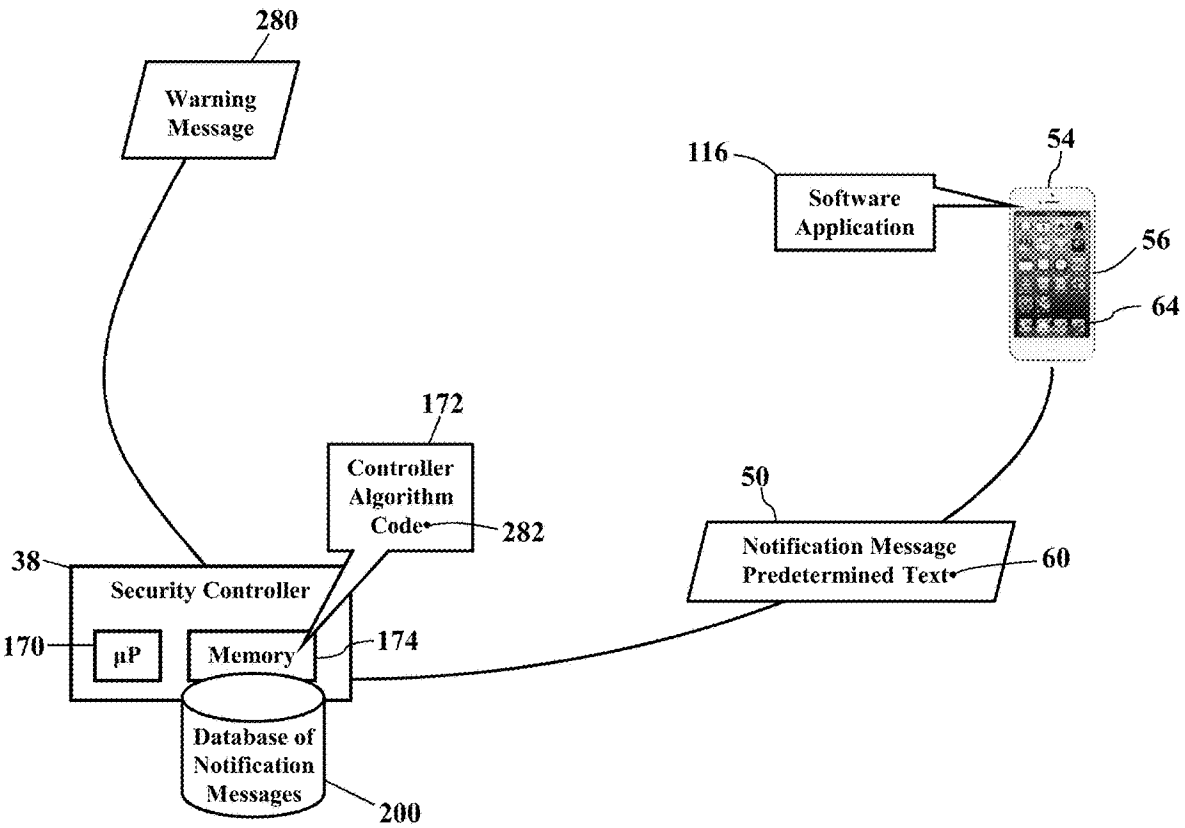
FIG. 25 illustrates warning messages, according to exemplary embodiments.

FIG. 25 illustrates warning messages, according to exemplary embodiments. Here exemplary embodiments may be extended for other emergency situations. Suppose, for example, the alarm controller 38 receives a warning message 280. The warning message 280 may describes some emergency situation not detected by the alarm controller 38. For example, the warning message 280 may be sent from a weather bureau describing an approaching storm or tornado. Similarly, the warning message 280 may be sent from a local police department describing a school emergency, shooting, or kidnapping. Regardless, when the alarm controller 38 receives the warning message 280, the controller algorithm 172 may first confirm the sender's address to ensure authenticity. If the sender's address is authenticated, the controller algorithm 172 may then query the database 200 of notification messages. Suppose, for example, the warning message 280 contains or identifies an emergency code 282. The emergency code 282 may be a shorthand designation for the emergency. The controller algorithm 172 queries the database 200 of notification messages for the emergency code 282 and retrieves the corresponding predetermined text 60. The database 200 of notification messages may thus further store or define electronic database associations between different emergency codes 282 and different predetermined text 60. The controller algorithm 172 may then generate and send the notification message 50 containing or describing the corresponding predetermined text 60.

Figure 26:
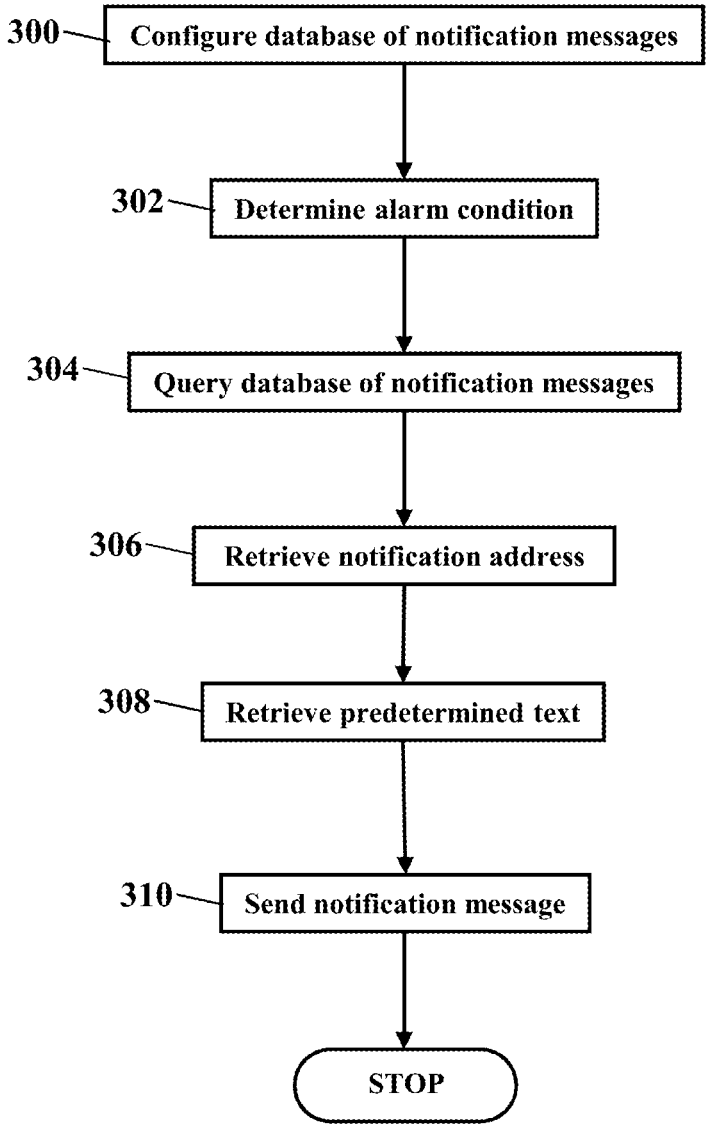
FIG. 26 is a flowchart illustrating a method or algorithm for security monitoring, according to exemplary embodiments

FIG. 26 is a flowchart illustrating a method or algorithm for security monitoring, according to exemplary embodiments. The database 200 of notification messages is configured (Block 300). The alarm condition 40 is determined (Block 302). The database 200 of notification messages is queried (Block 304). The notification address 52 (Block 306) and the predetermined text 60 (Block 308) are retrieved. The notification message 50 is sent (Block 310).

Figure 27:
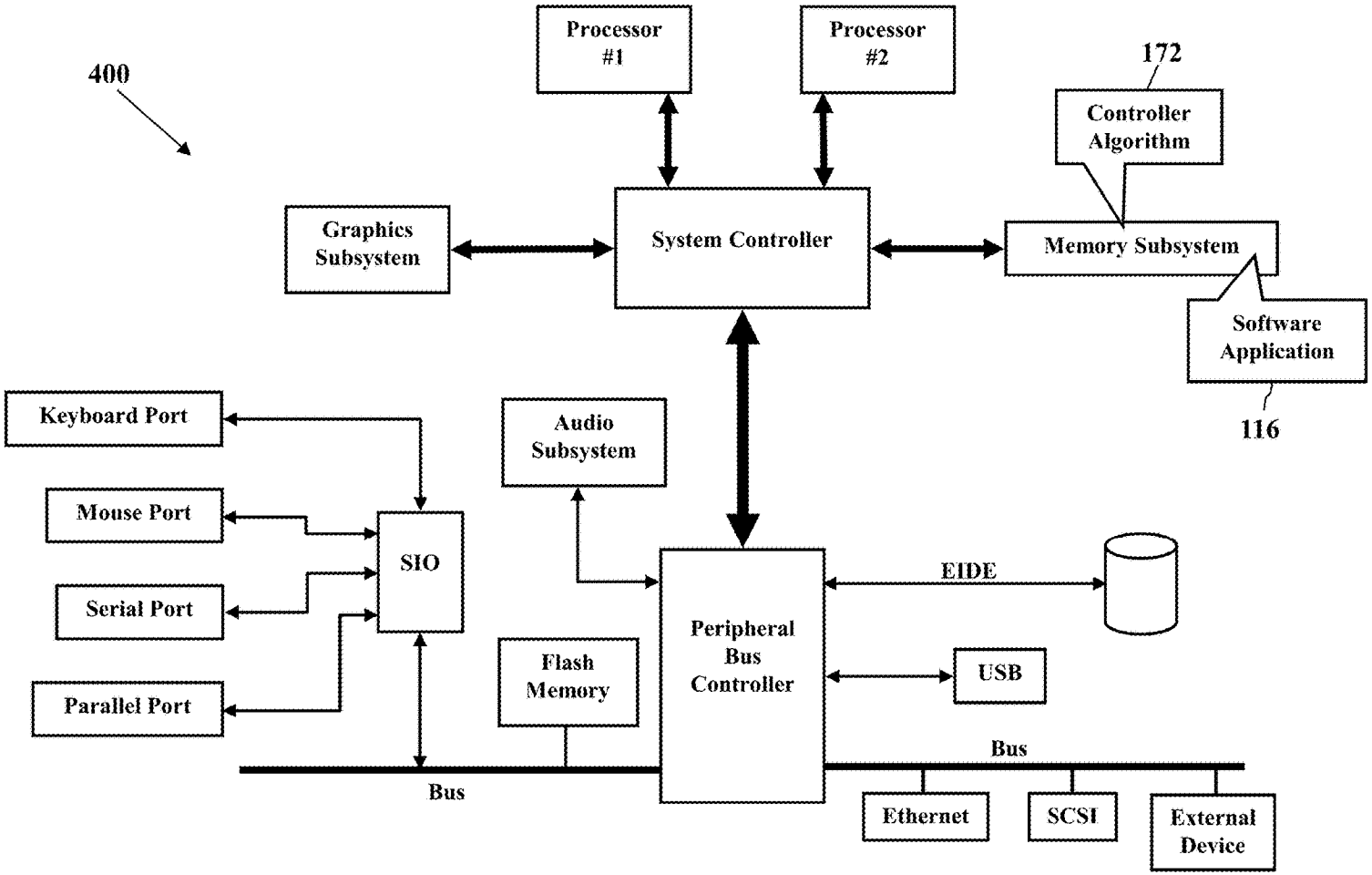
FIGS. 27-32 depict still more operating environments for additional aspects of the exemplary embodiments.

FIG. 27 is a schematic illustrating still more exemplary embodiments. FIG. 217 is a more detailed diagram illustrating a processor-controlled device 400. As earlier paragraphs explained, the controller algorithm 172 and/or the software application 116 may partially or entirely operate in any mobile or stationary processor-controlled device. FIG. 27, then, illustrates the controller algorithm 172 and/or the software application 116 stored in a memory subsystem of the processor-controlled device 400. One or more processors communicate with the memory subsystem and execute either, some, or all applications. Because the processor-controlled device 400 is well known to those of ordinary skill in the art, no further explanation is needed.

Figure 28:
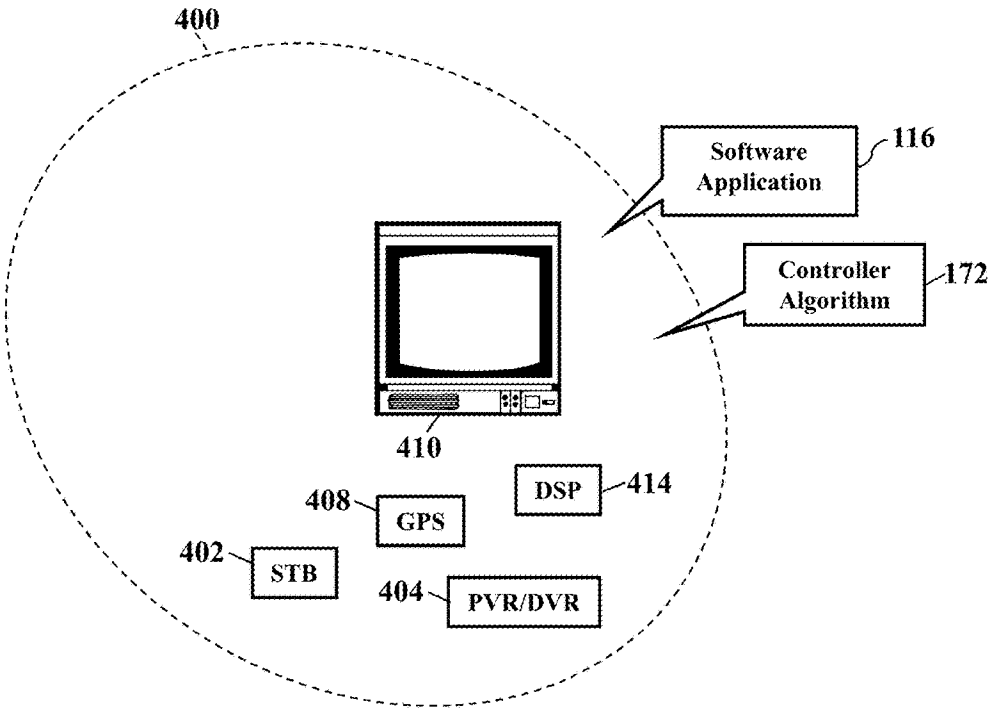

FIG. 28 depicts other possible operating environments for additional aspects of the exemplary embodiments. FIG. 28 illustrates the controller algorithm 172 and/or the software application 116 operating within various other processor-controlled devices 400. FIG. 28, for example, illustrates that the controller algorithm 172 and/or the software application 116 may entirely or partially operate within a set-top box ("STB") (402), a personal/digital video recorder (PVR/DVR) 404, a Global Positioning System (GPS) device 408, an interactive television 410, or any computer system, communications device, or processor-controlled device utilizing any of the processors above described and/or a digital signal processor (DP/DSP) 414. Moreover, the processor-controlled device 400 may also include wearable devices (such as watches), radios, vehicle electronics, clocks, printers, gateways, mobile/implantable medical devices, and other apparatuses and systems. Because the architecture and operating principles of the various devices 400 are well known, the hardware and software componentry of the various devices 400 are not further shown and described.

Figure 29:
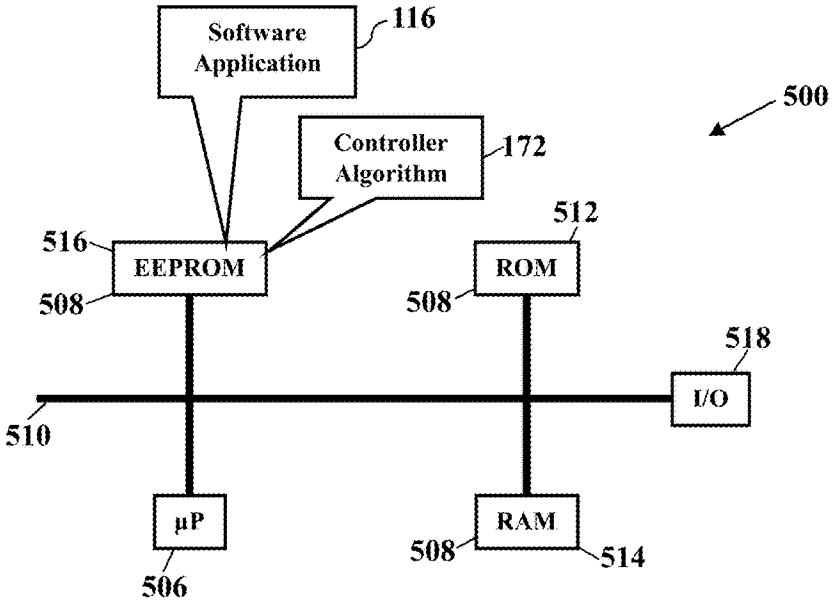
Figure 30:
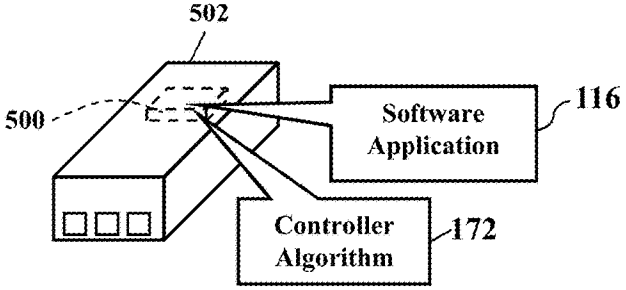
Figure 31:
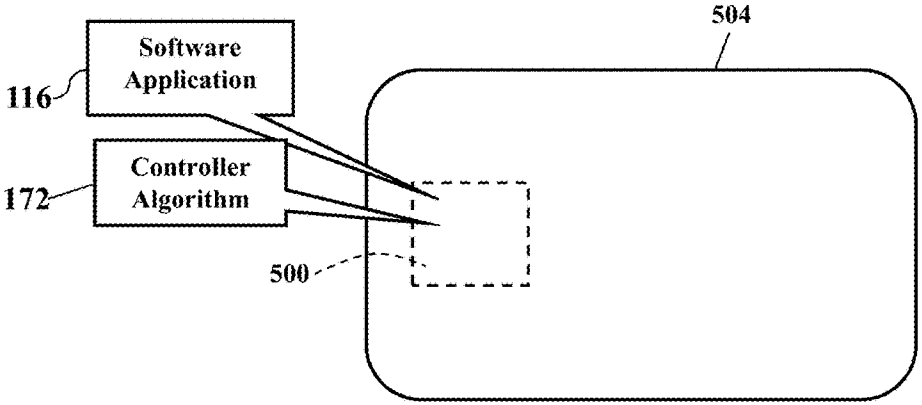

FIGS. 29-32 are schematics further illustrating operating environments for additional aspects of the exemplary embodiments. FIG. 29 is a block diagram of a Subscriber Identity Module 500, while FIGS. 30 and 31 illustrate, respectively, the Subscriber Identity Module 500 embodied in a plug 502 and in a card 504. As those of ordinary skill in the art recognize, the Subscriber Identity Module 500 may be used in conjunction with many communications devices (such as the client device 160 and the mobile smartphone 180). The Subscriber Identity Module 500 stores user information (such as the user's International Mobile Subscriber Identity, the user's $K_i$ number, and other user information) and any portion of the controller algorithm 172 and/or the software application 116. As those of ordinary skill in the art also recognize, the plug 502 and the card 504 each may physically or wirelessly interface with the mobile tablet computer 26 and the smartphone 412.

FIG. 29 is a block diagram of the Subscriber Identity Module 500, whether embodied as the plug 502 of FIG. 30 or as the card 504 of FIG. 31. Here the Subscriber Identity Module 500 comprises a microprocessor 506 (μP) communicating with memory modules 508 via a data bus 510. The memory modules 508 may include Read Only Memory (ROM) 512, Random Access Memory (RAM) and or flash memory 514, and Electrically Erasable-Programmable Read Only Memory (EEPROM) 516. The Subscriber Identity Module 500 stores some or all of the controller algorithm 172 and/or the software application 116 in one or more of the memory modules 508. FIG. 29 shows the controller algorithm 172 and/or the software application 116 residing in the Erasable-Programmable Read Only Memory 516, yet either module may alternatively or additionally reside in the Read Only Memory 512 and/or the Random Access/Flash Memory 514. An Input/Output module 518 handles communication between the Subscriber Identity Module 500 and the communications device. Because Subscriber Identity Modules are well known in the art, this patent will not further discuss the operation and the physical/memory structure of the Subscriber Identity Module 500.

Figure 32:
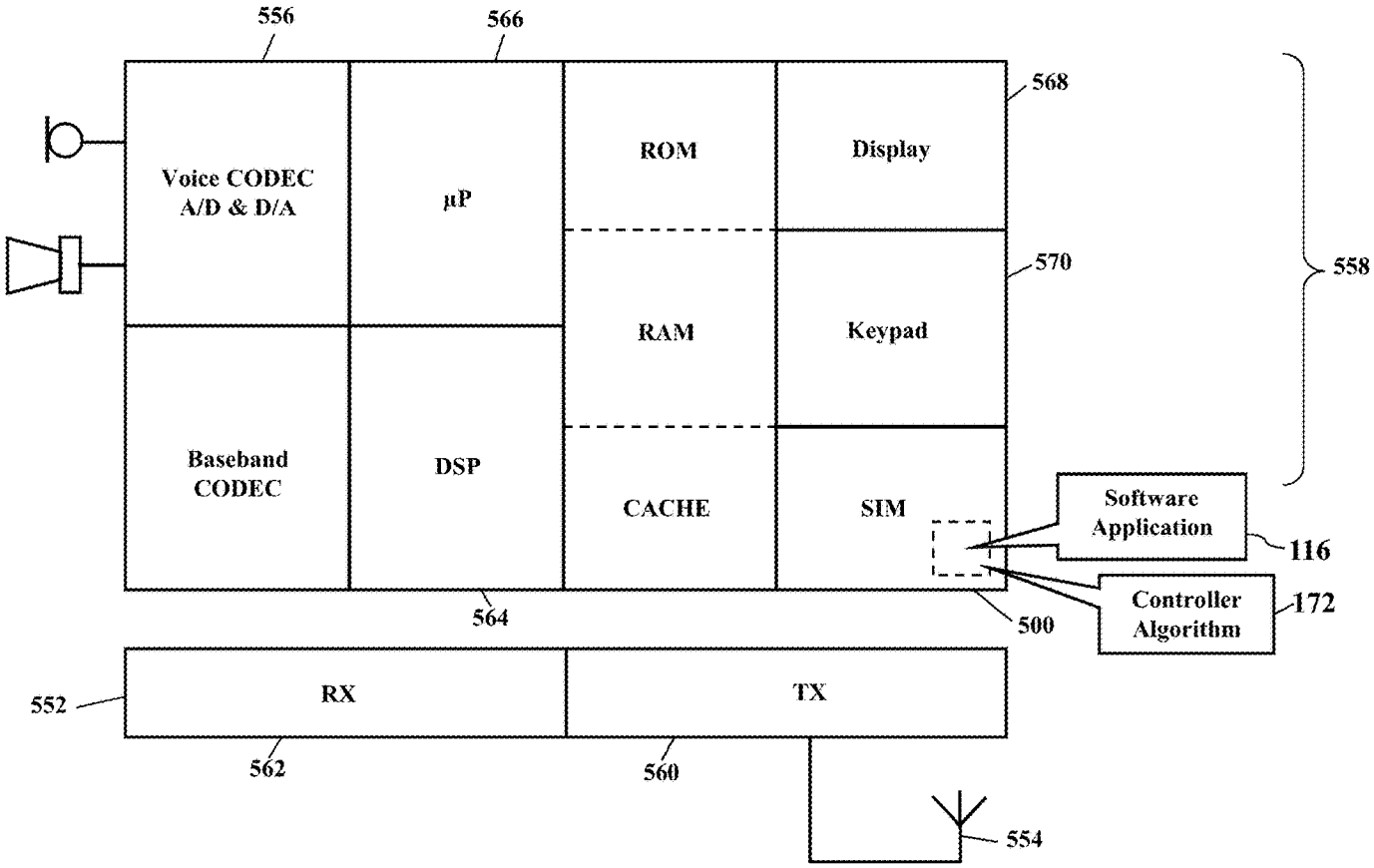

FIG. 32 is a schematic further illustrating the operating environment, according to exemplary embodiments. FIG. 32 is a block diagram illustrating some componentry of the security controller 38 and/or the mobile smartphone 56. The componentry may include one or more radio transceiver units 552, an antenna 554, a digital baseband chipset 556, and a man/machine interface (MMI) 558. The transceiver unit 552 includes transmitter circuitry 560 and receiver circuitry 562 for receiving and transmitting radio-frequency (RF) signals. The transceiver unit 552 couples to the antenna 554 for converting electrical current to and from electromagnetic waves. The digital baseband chipset 556 contains a digital signal processor (DSP) 564 and performs signal processing functions for audio (voice) signals and RF signals. As FIG. 32 shows, the digital baseband chipset 556 may also include an on-board microprocessor 566 that interacts with the man/machine interface (MMI) 558. The man/machine interface (MMI) 558 may comprise a display device 568, a keypad 570, and the Subscriber Identity Module 500. The on-board microprocessor 566 may also interface with the Subscriber Identity Module 500 and with the controller algorithm 172 and/or the software application 116.

Exemplary embodiments may be applied to any signaling standard. As those of ordinary skill in the art recognize, FIGS. 29-32 may illustrate a Global System for Mobile (GSM) communications device. That is, exemplary embodiments may utilize the Global System for Mobile (GSM) communications signaling standard. Those of ordinary skill in the art, however, also recognize that exemplary embodiments are equally applicable to any communications device utilizing the Time Division Multiple Access signaling standard, the Code Division Multiple Access signaling standard, the "dual-mode" GSM-ANSI Interoperability Team (GAIT) signaling standard, or any variant of the GSM/CDMA/TDMA signaling standard. Exemplary embodiments may also be applied to other standards, such as the I.E.E.E. 802 family of standards, the Industrial, Scientific, and Medical band of the electromagnetic spectrum, BLUETOOTH®, and any other.

Exemplary embodiments may be physically embodied on or in a computer-readable storage medium. This computer-readable medium, for example, may include CD-ROM, DVD, tape, cassette, floppy disk, optical disk, memory card, memory drive, and large-capacity disks. This computer-readable medium, or media, could be distributed to end-subscribers, licensees, and assignees. A computer program product comprises processor-executable instructions for security services, as the above paragraphs explained.

While the exemplary embodiments have been described with respect to various features, aspects, and embodiments, those skilled and unskilled in the art will recognize the exemplary embodiments are not so limited. Other variations, modifications, and alternative embodiments may be made without departing from the spirit and scope of the exemplary embodiments.

The invention claimed is:

1. A method, comprising:

determining, by an alarm controller associated with a security system, an alarm condition associated with a sensor identifier;

retrieving, by the alarm controller, an audio file recorded in real time that describes a personalized evacuation instruction describing an evacuation path;

querying, by the alarm controller, an electronic database for the sensor identifier associated the alarm condition, the electronic database electronically associating sensor identifiers to conferees to a conference call, the sensor identifiers including the sensor identifier associated with the alarm condition;

identifying, by the alarm controller, the conferees to the conference call in the electronic database that are electronically associated with the sensor identifier;

identifying, by the alarm controller, network addresses associated with the conferees identified in the electronic database;

initiating, by the alarm controller, the conference call to the conferees in response to the alarm condition; and playing, by the alarm controller, the audio file recorded in real time that describes the personalized evacuation instruction describing the evacuation path.

2. The method of claim 1, further comprising retrieving personalized text from the electronic database.

3. The method of claim 2, further comprising sending the personalized text in an electronic notification message.

4. The method of claim 1, further comprising receiving personalized text entered by a user to explain the alarm condition in the user's own words.

5. A system, comprising:

a hardware processor; and a memory device, the memory device storing instructions, the instructions when executed causing the hardware processor to perform operations, the operations comprising:

receiving an electronic notification message sent from an alarm controller to a mobile device, the alarm controller associated with a security system, the electronic notification message providing a remote notification of a sensor identifier associated with an alarm condition determined by the alarm controller;

recording in real time an audio file that describes a personalized evacuation instruction describing an evacuation path;

querying an electronic database stored by the mobile device for the sensor identifier, the electronic database electronically associating conferees for a conference call to sensor identifiers including the sensor identifier sent from the alarm controller;

identifying the conferees specified by the electronic database that are electronically associated with the sensor identifier;

automatically initiating the conference call to the conferees in response to the receiving of the electronic notification message; and playing the audio file recorded in real time that describes the personalized evacuation instruction describing the evacuation path.

6. The system of claim 5, wherein the operations further comprise displaying personalized text via a display device of the mobile device.

7. The system of claim 5, wherein the operations further comprise automatically executing the audio file in response to the receiving of the electronic notification message sent from the alarm controller.

8. The system of claim 5, wherein the operations further comprise querying a table representing the electronic database, the table having columns and rows that electronically associate different ones of the sensor identifiers to different ones of the conferees to the conference call.

9. The system of claim 5, wherein the operations further comprise retrieving network addresses that are electronically associated with the conferees.

10. The system of claim 9, wherein the operations further comprise initiating the conference call to the network addresses.

11. The system of claim 5, wherein the operations further comprise retrieving a personalized audio file stored by the mobile device that is electronically associated with the sensor identifier.

12. The system of claim 11, wherein the operations further comprise processing the personalized audio file to play a personalized audio announcement describing the alarm condition determined by the alarm controller.

13. A memory device storing instructions that when executed cause a hardware processor to perform operations, the operations comprising:

determining a sensor identifier associated with an alarm condition generated by an alarm controller associated with a security system;

recording in real time an audio file that describes a personalized evacuation instruction describing an evacuation path within a residence;

querying an electronic database for the sensor identifier, the electronic database stored by the alarm controller and electronically associating conferees for a conference call to sensor identifiers including the sensor identifier associated with the alarm condition;

identifying the conferees in the electronic database that are electronically associated with the sensor identifier;

automatically initiating the conference call to the conferees in response to the alarm condition; and playing the audio file recorded in real time that describes the personalized evacuation instruction describing the evacuation path within the residence.

14. The memory device of claim 13, wherein the operations further comprise adding an entry to the electronic database, the entry electronically associating the sensor identifier to personalized text entered by a residential user that describes the alarm condition.

15. The memory device of claim 14, wherein the operations further comprise retrieving the personalized text from the electronic database.

16. The memory device of claim 15, wherein the operations further comprise sending the personalized text in an electronic notification message sent to devices associated with the network addresses.

17. The memory device of claim 13, wherein the operations further comprise playing the audio file in real time during the alarm condition to provide the personalized evacuation instruction.

* * * * *